US009155360B1

(12) United States Patent
Mowad

(10) Patent No.: US 9,155,360 B1
(45) Date of Patent: Oct. 13, 2015

(54) BELT BUCKLE

(71) Applicant: Antoine Mowad, Waterbury, CT (US)

(72) Inventor: Antoine Mowad, Waterbury, CT (US)

( * ) Notice: Subject to any disclaimer, the term of this patent is extended or adjusted under 35 U.S.C. 154(b) by 0 days.

(21) Appl. No.: 14/192,824

(22) Filed: Feb. 27, 2014

(51) Int. Cl.
*A44B 11/00* (2006.01)
*A44B 11/12* (2006.01)
*A44B 11/25* (2006.01)

(52) U.S. Cl.
CPC ..... *A44B 11/12* (2013.01); *A44B 11/125* (2013.01); *A44B 11/2565* (2013.01); *Y10T 24/4016* (2015.01); *Y10T 24/4072* (2015.01)

(58) Field of Classification Search
CPC .. A44B 11/12; A44B 11/125; A44B 11/2565; Y10T 24/4072; Y10T 24/4016
See application file for complete search history.

(56) References Cited

U.S. PATENT DOCUMENTS

| | | | | | |
|---|---|---|---|---|---|
| 3,884 | A * | 1/1845 | Beverly | ..... | 24/170 |
| 238,247 | A * | 3/1881 | Parsons | ..... | 24/191 |
| 361,166 | A * | 4/1887 | Lewis et al. | ..... | 24/191 |
| 1,262,773 | A * | 4/1918 | Gillan | ..... | 24/170 |
| 1,438,898 | A * | 12/1922 | Carmill | ..... | 24/191 |
| 3,636,596 | A * | 1/1972 | Iizuka | ..... | 24/191 |
| 2002/0035767 | A1 * | 3/2002 | Sekanina | ..... | 24/170 |

* cited by examiner

*Primary Examiner* — Robert J Sandy
*Assistant Examiner* — Louis Mercado
(74) *Attorney, Agent, or Firm* — Raymond A. Nuzzo

(57) ABSTRACT

A belt buckle has a buckle body having an interior region for receiving a belt and a pivoting member that is pivotally attached to the buckle body. The pivoting member can pivot in a first direction to a first position and in a second, opposite direction to a second position. When the pivoting member is in the first position, the pivoting member contacts a section of belt within the buckle. When there is tension on the belt, the tension pulls the pivoting member downward so as to create firm and frictional contact between the pivoting member and the section of belt thereby preventing the belt from becoming loose. When the pivoting member is in the second position, the section of belt can be moved freely through the buckle in one direction to tighten the belt around the waist of a wearer or in an opposite direction to loosen the belt around the wearer's waist or withdraw the section of belt from the buckle.

13 Claims, 32 Drawing Sheets

BELT BUCKLE

CROSS-REFERENCE TO RELATED APPLICATIONS

None.

BACKGROUND OF THE INVENTION (1) Field of the Invention

The present invention generally relates to a belts and belt buckles.

(2) Description of the Related Art

Belts and belt buckles are well known in the art and have been used by people for many years to hold up pants, trousers or other clothing.

SUMMARY OF THE INVENTION

In one aspect, the present invention is directed to a belt assembly for use with garments, comprising a belt (200) having a first end (202), a second, free end (206) and an intermediate belt section (204) that is between first end (202) and second, free end (206). The belt assembly further comprises a belt buckle (10) comprising a buckle body (12) which comprises an interior region (14) and a first side (16) having an opening (18) that exposes the interior region (14). The first side (16) comprises a peripheral portion (20) that extends about opening (18). The buckle body (12) further comprises a second side (22) that is opposite to the first side (16), a first buckle end (24) and an opposite second buckle end (26). Each buckle end (24, 26) has an opening (28, 30), respectively, that provides access to the interior region (14). The openings (28, 30) and the interior region (14) is sized to allow the second free end (206) and intermediate belt section (204) of belt 200 to pass therethrough. The buckle body (12) further comprises sidewalls (32) and (34). Movement of the intermediate belt section (204) of belt (200) through buckle body (12) in a first direction (350) causes tightening of the belt (200) around a wearer's waist and movement of the intermediate belt section (204) through buckle body (12) in an opposite second direction (352) causes loosening of the belt (200). The belt assembly further comprises a pin member (36) that is attached to the sidewalls (32, 34) of the buckle body (12) and extends across the interior region (14). The belt assembly further comprises a cap section (38) that is removably attached to the peripheral portion (20) of the first side (16) and positioned within the opening (18). The cap section (38) is sized to cover a portion of the interior region (14) and has a first end (40) that is in proximity to and spaced apart from the pin member (36) by a gap (42). The cap section (38) has a second end (44) that is adjacent to the peripheral portion (20), a top side (46) and a bottom side (48). A structure (50) extends from the bottom side (48). A pin member (52) is attached to the structure (50). The belt assembly further comprises a locking member (60) that is movable to a closed position wherein the locking member (60) frictionally engages a portion of the intermediate belt section (204) when such portion of the intermediate belt section (204) is within the interior region (14) so as to prevent movement of the intermediate belt section (204) through the interior region (14). The locking member (60) is also movable to an open position that allows the intermediate belt section (204) within interior region (14) to be moved either in the first direction (350) or the second direction (352) through interior (14) and through openings (28) and (30) in the first and second buckle ends (24) and (26), respectively. The locking member (60) comprises a first end (64), a second end (66), sidewalls (68, 70), curved or sloping section (71), a top side (72) and a bottom side (73). The first end (64) has a height that is significantly greater than the height of the second end (66). The locking member (60) further includes laterally extending slot (74) which is substantially parallel to the first end (64) and second end (66). The top side (72) has portion (76) that is between first end (64) and slot (74) and a sloped portion (78) that is part of the curved section (71). At least one friction member (82) is attached to the bottom side (73) of the locking member (60) for frictionally engaging a portion of intermediate belt section (204) that is within interior region (14). A third pin member (90) is positioned within the slot (74) of the locking member (60) and attached to the sidewalls (68, 70). The belt assembly further comprises a tension band (100) that exhibits a degree of tension and comprises first end (102) that is wrapped about the first pin member (52) and a second end (104) that extends through the gap (42) and is wrapped about the third pin member (90) in slot (74). The tension band (100) urges locking member (60) to the open position such that when the locking member (60) is in the open position, (i) the sloped portion (78) of curved section (71) is forced against the second pin member (36), (ii) the first end (64) of the locking member (60) is completely external to the interior region (14) of the buckle body (12), and (iii) friction member (82) is oriented in a direction such that the friction member (82) does not face first end (202) of belt (200). When the locking member (60) is in the closed position and a portion of intermediate belt section (204) is within interior region (14) and extends through opening (28) in buckle end (24), (i) the first end (64) of locking member (60) is adjacent the peripheral portion (20) of the buckle body (12), (ii) the bottom side (73) of the locking member (60) is completely within the interior region (14) so that friction member (82) frictionally engages the portion of intermediate belt section (204) that is within the interior region (14), and (iii) the curved section (71) of locking member (60) is firmly positioned between the pin member (36) and the portion of intermediate belt section (204) that is within the interior region (14). As the locking member (60) is being moved to the closed position, the constant tension of tension band (100) pulls the curved section (71) of the locking member (60) against contact pin member (36). In order to move locking member (60) to the closed position, a wearer moves locking member (60) with sufficient force to overcome the tension on tension band (100). When a portion of intermediate belt section (204) is within interior region (14) and extends from opening (28) in buckle end (24), movement of intermediate belt section 204 in the first direction (350) creates a force (400) that breaks the frictional engagement between the friction member (82) and the portion of intermediate belt section (204) that is within interior region (14) thereby causing the friction member (82) to release the intermediate belt section (204) and the tension on tension band (100) to pull locking member (60) to the open position.

In a related aspect, the present invention is directed to a belt buckle (10) comprising a buckle body (12) which comprises an interior region (14) and a first side (16) having an opening (18) that exposes the interior region (14). The first side (16) comprises a peripheral portion (20) that extends about opening (18). The buckle body (12) further comprises a second side (22) that is opposite to first side (16), a first buckle end (24) and an opposite second buckle end (26). Each buckle end (24, 26) has an opening (28, 30), respectively, that provides access to the interior region (14). The openings (28, 30) and the interior region (14) are sized to allow a portion of a belt to pass therethrough. The buckle body (12) further comprises a pair sidewalls (32, 34) that are contiguous with the first buckle end (24) and second buckle end (26). The buckle body (12) further comprises a bottom surface (55) and a plurality of protruding tabs (58) that vertically extend from the bottom surface (55). The buckle (10) further comprises a pin member (36) that is attached to the sidewalls (32, 34) of the buckle body (12) and extends across the interior region (14). The buckle (10) further comprises a cap section (38) that is removably attached to the peripheral portion (20) of the first side (16) and is positioned within the opening (18). The cap section (38) is sized to cover a portion of the interior region (14) and has a first end (40) that is in proximity to and spaced apart from the pin member (36) by a gap (42). The cap section (38) has a second end (44) that is adjacent to the peripheral portion (20), a top side (46) and a bottom side (48). Structure 50 extends from the bottom side (48). A pin member (52) is attached to the structure (50). The buckle (10) further comprises a locking member (60) that is movable between a closed position and an open position. When a portion of a belt (200) is within the interior region (14) and it is desired to prevent movement of the belt (200) through the interior region (14), the wearer moves the locking member (60) to the closed position so that the locking member (60) frictionally engages the aforesaid portion of the belt (200) that is within the interior region (14). When the locking member (60) is in the open position, the wearer can move belt (200) through interior (14) and openings (28) and (30) in the first and second buckle ends (24) and (26), respectively, in either the first direction (350) or the opposite second direction (352). The locking member (60) comprises a first end (64), a second end (66), sidewalls (68, 70), curved section (71), a top side (72) and a bottom side (73). The first end (64) has a height that is significantly greater than the height of the second end (66). The locking member (60) further comprises a laterally extending slot (74) that is substantially parallel to the first end (64) and the second end (66). The top side (72) has portion (76) that is between first end (64) and the slot (74). The top side (72) further includes sloping or curved portion (78) that is part of curved section (71). The buckle (10) further comprises at least one friction member (82) that is attached to the bottom side (73) of the locking member (60) for frictionally engaging a portion of a belt located within interior region (14). The buckle (10) further comprises a pin member (90) that is positioned within the slot (74) of the locking member (60) and attached to the sidewalls (68, 70). The buckle (10) further comprises a tension band (100) that exhibits a degree of tension and comprises a first end (102) that is wrapped about the pin member (52) and a second end (104) that extends through the gap (42) and is wrapped about the pin member (90) in slot (74). The tension band (100) exerts a constant tension on the locking member (60) which urges the locking member (60) to the open position such that when the locking member (60) is in the open position, (i) the sloping portion (78) of curved section (71) is pulled against the pin member (36), (ii) the first end (64) of the locking member (60) is completely external to the interior region (14) of the buckle body (12), and (iii) friction member (82) is oriented in a direction such that the friction member (82) does not face bottom surface (55) of buckle body (12). When the locking member (60) is in the closed position, (i) the first end (64) of locking member (60) is adjacent the peripheral portion (20) of the buckle body (12), (ii) the bottom side (73) of the locking member (60) is completely within the interior region (14) so that friction member (82) faces interior bottom surface (55) of buckle body (12), and (iii) the curved section (71) of the locking member (60) is positioned between the pin member (36) and interior bottom surface (55). As the locking member (60) is moved to the closed position, the constant tension of tension band (100) pulls the curved section (71) against the pin member (36). When a portion of a belt (200) is within interior region (14) and extends from opening (28) and a wearer desires to move locking member (60) to the closed position, a wearer moves locking member (60) with sufficient force to overcome the tension on tension band (100) so that friction member (82) frictional engages the portion of the belt (200) within interior region (14). Movement in direction (350) of any portion of the belt (200) that is external to the interior region (14) produces a force (400) that breaks the frictional engagement between the friction member (82) and the portion of belt (200) within interior region (14) thereby causing the friction member (82) to release the portion of the belt (200) and allowing the tension on tension band (100) to pull locking member (60) to the open position.

Other aspects and advantages of the invention will become apparent from the following detailed description taken in conjunction with the accompanying drawings which illustrate, by way of example, the principles of the invention.

BRIEF DESCRIPTION OF THE DRAWINGS

The invention will be readily understood by the following detailed description in conjunction with the accompanying drawings, wherein like reference numerals designate like structural elements, and in which.

DESCRIPTION OF THE PREFERRED EMBODIMENTS

Figure 1:
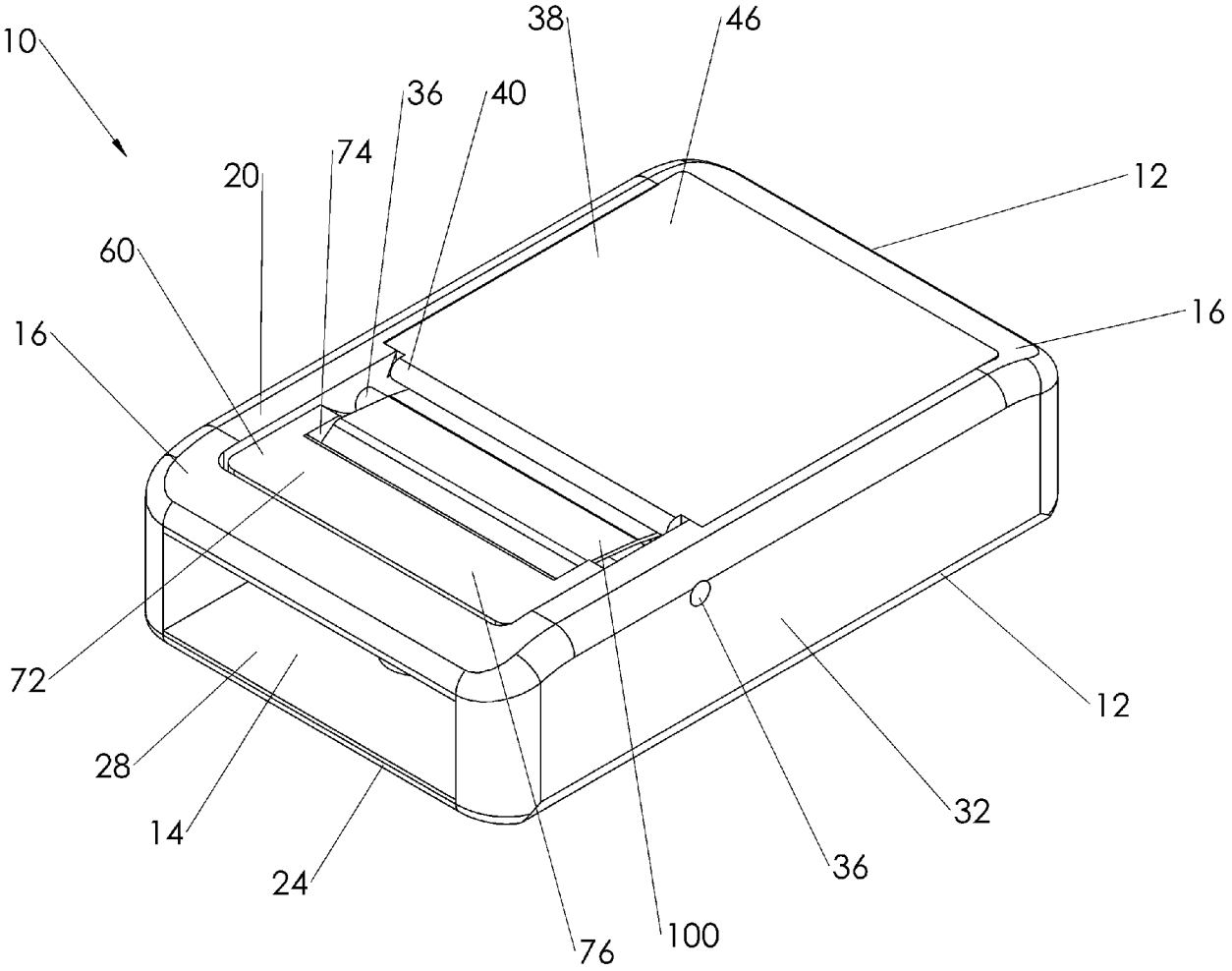
FIG. 1 is a perspective view of the belt buckle of the present invention.
Figure 2:
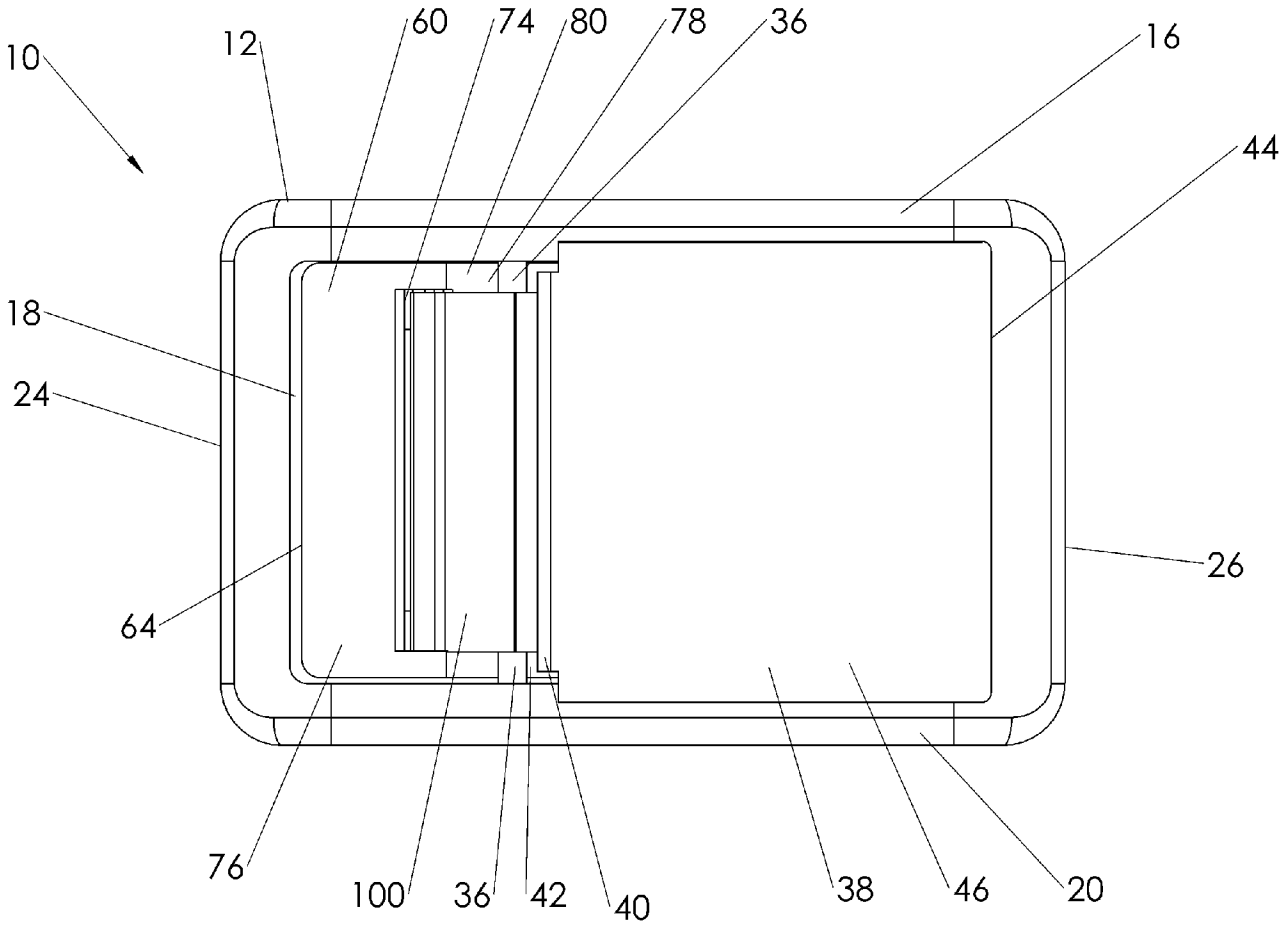
FIG. 2 is a top view of the belt buckle.
Figure 3:
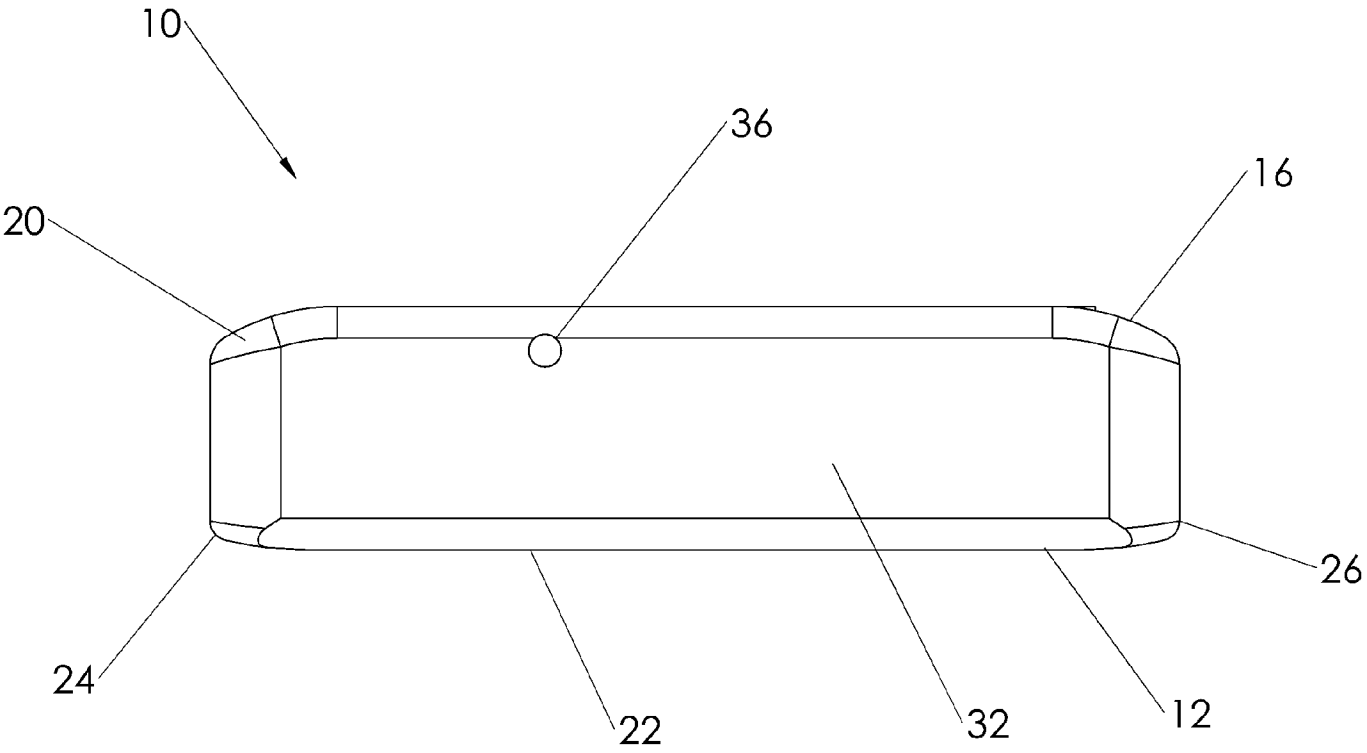
FIG. 3 is a side view of the belt buckle.
Figure 4:
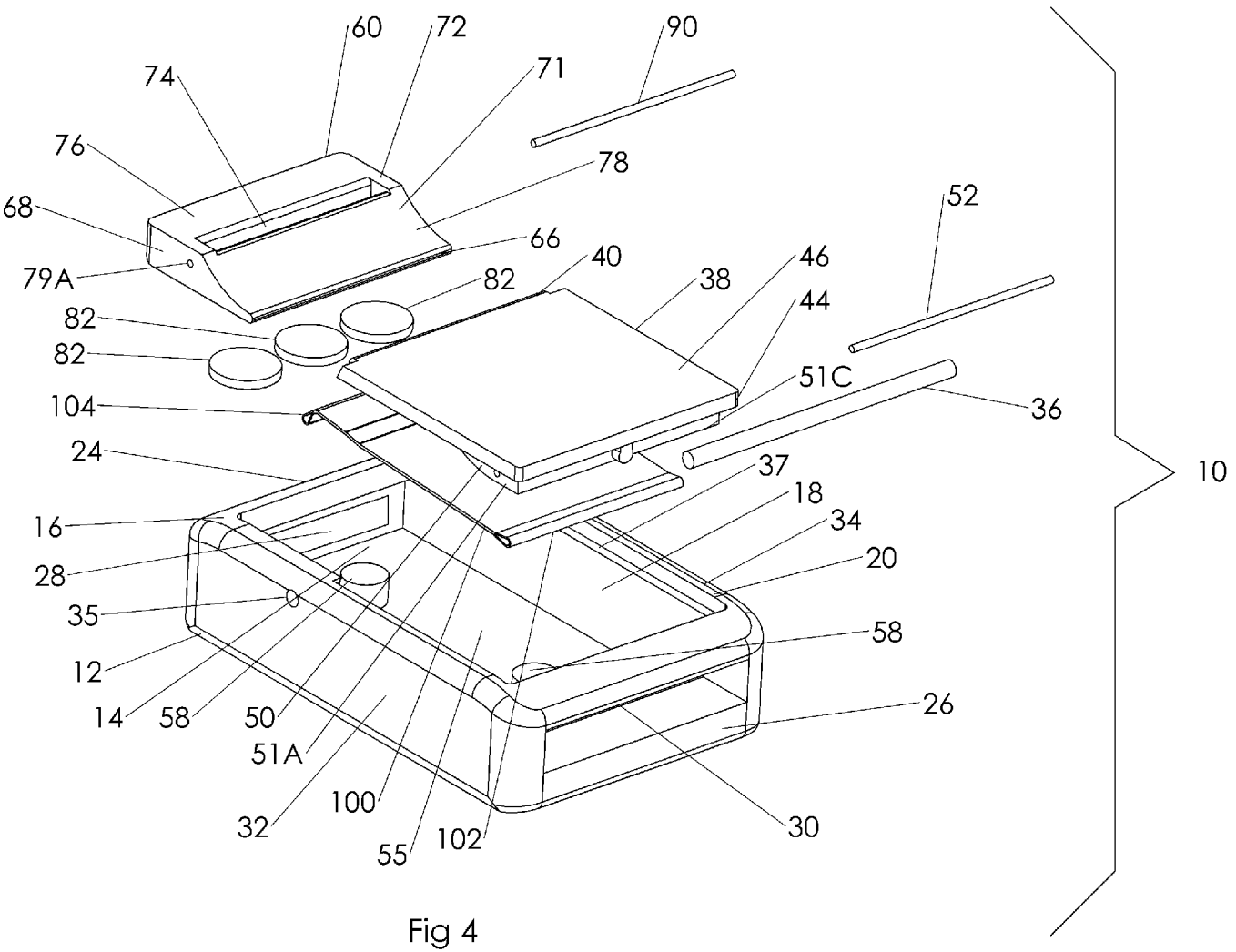
FIG. 4 is an exploded view of the belt buckle.

Referring to FIGS. 1-5, there is shown belt buckle 10 in accordance with one embodiment of the present invention. Belt buckle 10 is used with belt 200. Belt 200 comprises belt end 202, intermediate belt section 204 and free end 206. Belt end 202 is attached or secured to belt buckle 10 as will be described in the ensuing description. Belt buckle 10 comprises buckle body 12. Buckle body 12 comprises an interior region 14 and a first side 16 having an opening 18 that exposes the interior region 14. First side 16 comprises peripheral portion 20 that extends about opening 18. Buckle body 12 further comprises opposite second side 22, first buckle end 24 and an opposite second buckle end 26. Buckle ends 24 and 26 have openings 28 and 30, respectively, that provides access to the interior region 14. Openings 28 and 30 and interior region 14 are sized to allow portions of belt 200 to pass therethrough. Buckle body 12 further comprises sidewalls 32 and 34 that are contiguous with the buckle ends 24 and 26. Sidewalls 32 and 34 include through-holes 35 for receiving pin member 36. Thus, pin member 36 is attached or mounted to the sidewalls 32 and 34 and extends across the interior region 14. Buckle body 12 includes rib or ledge 37 that is on the interior side of sidewalls 32 and 34 and buckle end 26 as shown in FIG. 4. The purpose of ledge 37 is discussed in the ensuing description.

Figure 10:
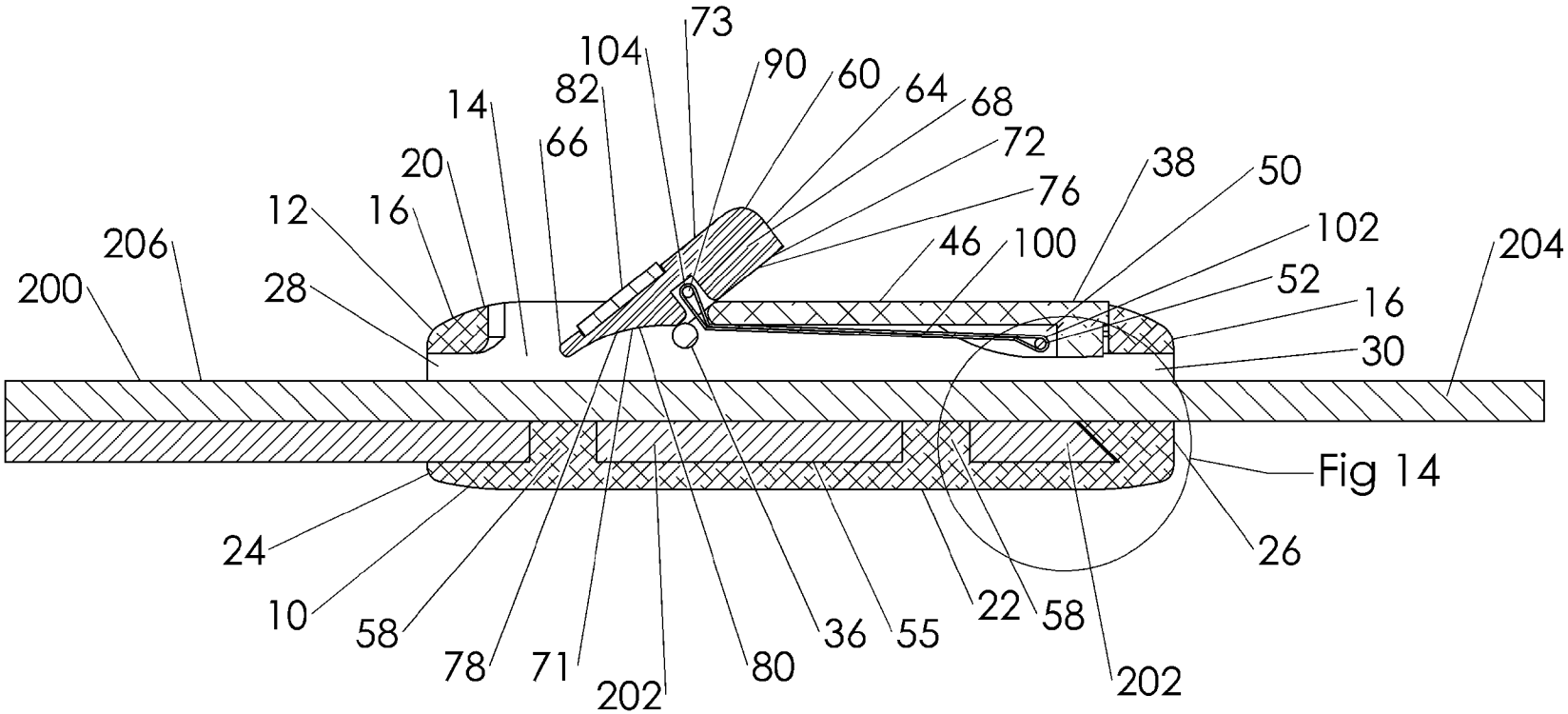
FIG. 10 is a cross-sectional view taken along line 10-10 in FIG. 9.
Figure 14:
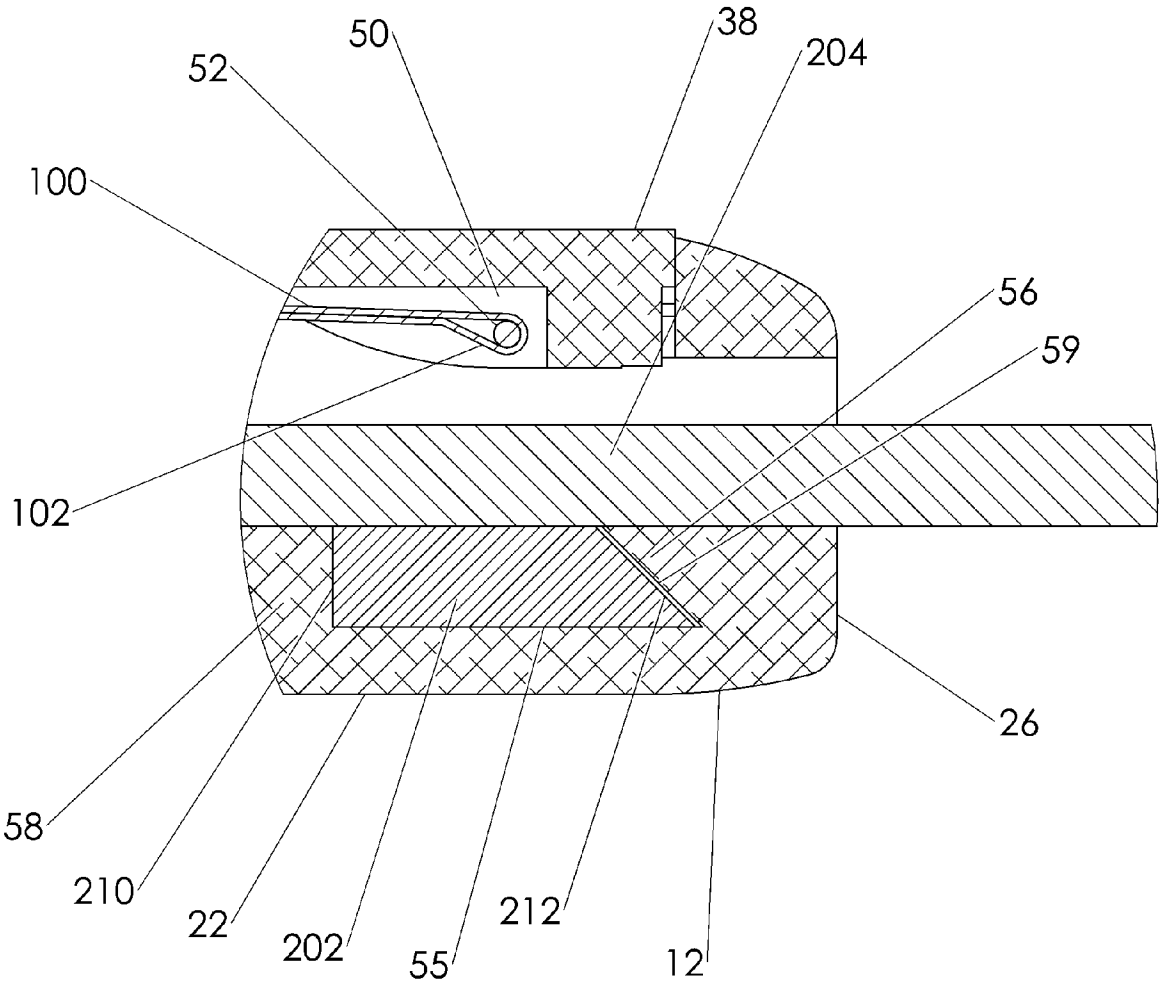
FIG. 14 is an enlarged view of a portion of the view shown in FIG. 10.

Referring to FIGS. 10 and 14, buckle body 12 further comprises interior bottom surface 55, interior wall 56 and upstanding tabs or protruding members 58 that upwardly extend from interior bottom surface 55. Interior wall 56 includes angled portion 59. Belt end 202 is positioned within interior region 14 and attached to buckle body 12. Belt end 202 has through-holes 208 and 210 and an angled edge 212. Upstanding tabs 58 are frictionally inserted into through-holes 208 and 210 and angled edge 212 is fitted under angled portion 59 of interior wall 56. In an alternate embodiment, an adhesive is also used to attach belt end 202 to interior bottom surface 55.

Figure 5:
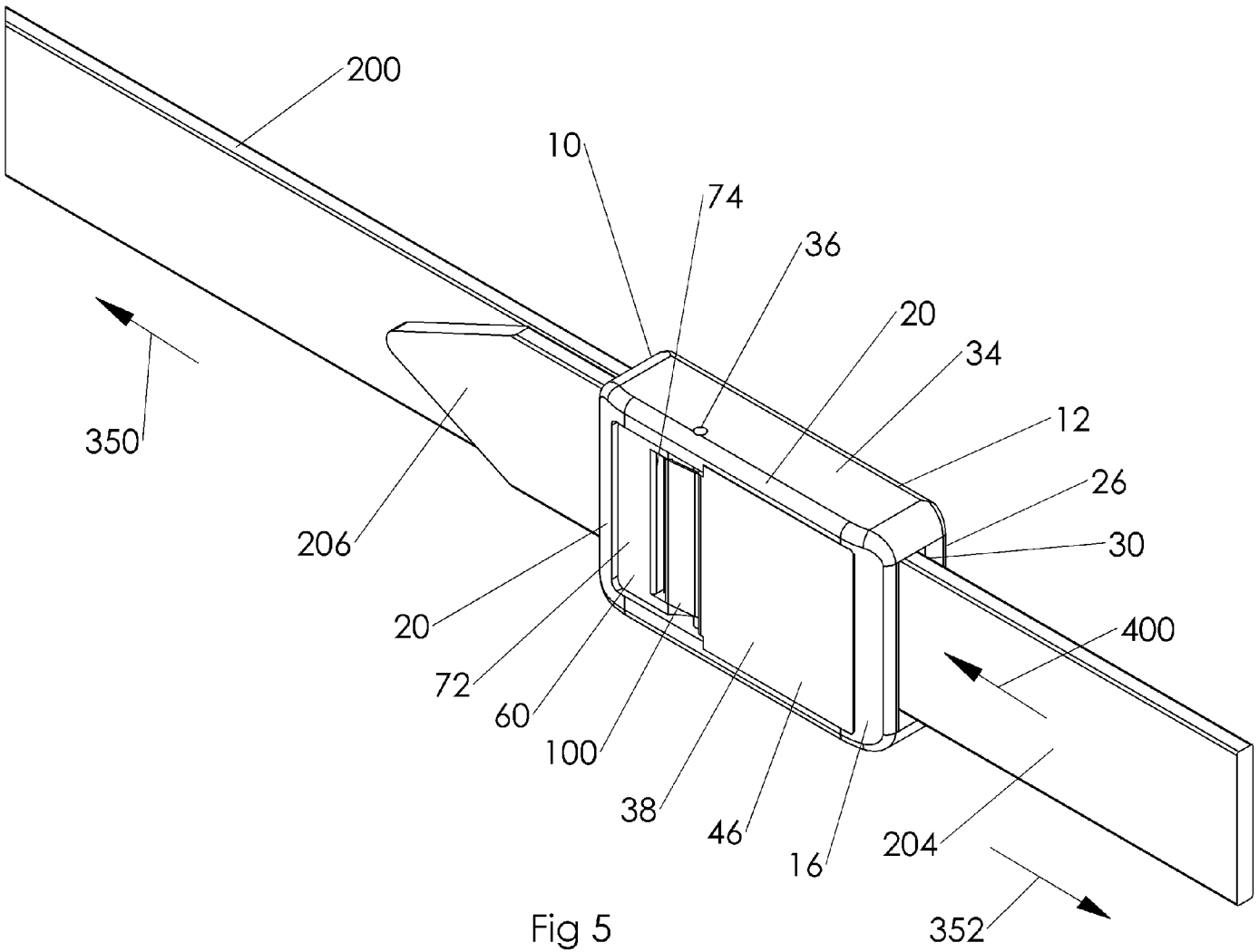
FIG. 5 is a perspective view of the belt buckle and a belt, the buckle being attached to the belt buckle.

Referring to FIG. 5, when free end 206 of belt 200 is inserted through opening 30 and interior region 14 and extends from opening 28 and locking member 60 is in the open position, movement of belt section 204 in a first direction 350 causes tightening of the belt 200 around the wearer's waist and movement of belt section 204 in an opposite second direction 352 causes loosening of the belt 200 around the wearer's waist. Locking member 60 is described in detail in the ensuing description.

Figure 11:
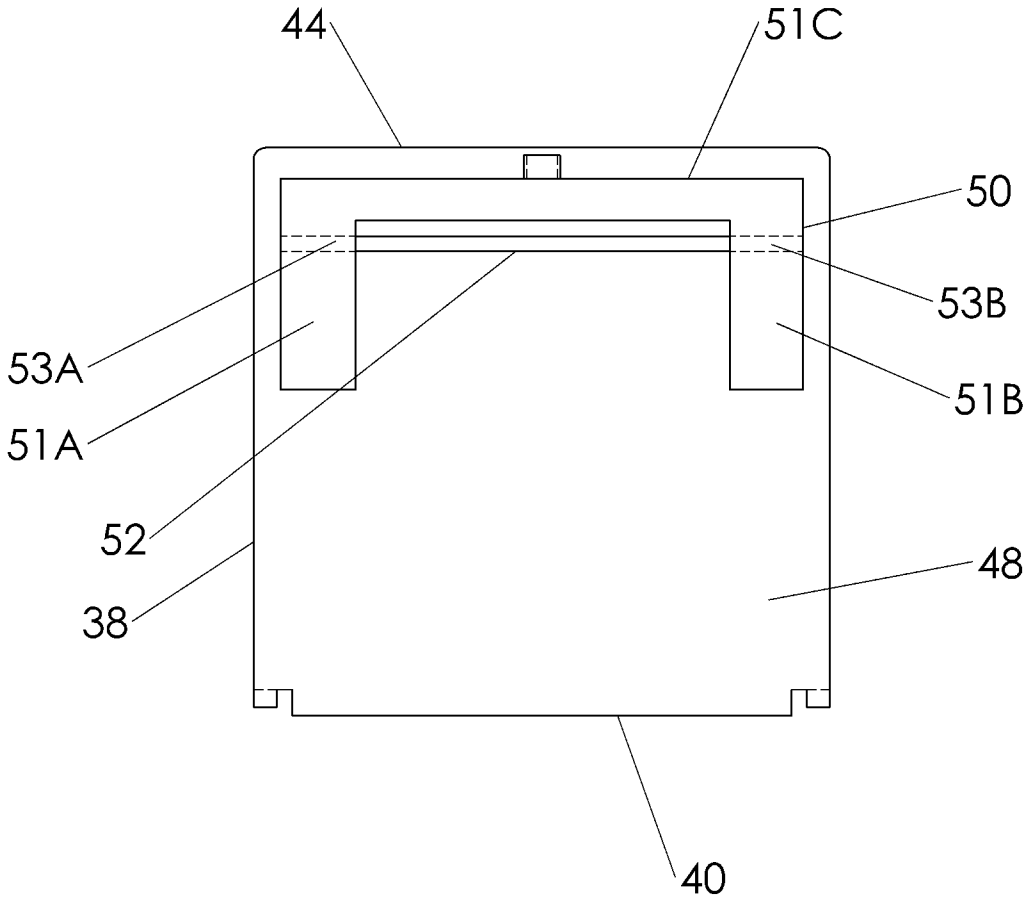
FIG. 11 is a bottom view of a cap section depicted in FIGS. 1, 2, 4 and 5.
Figure 12:
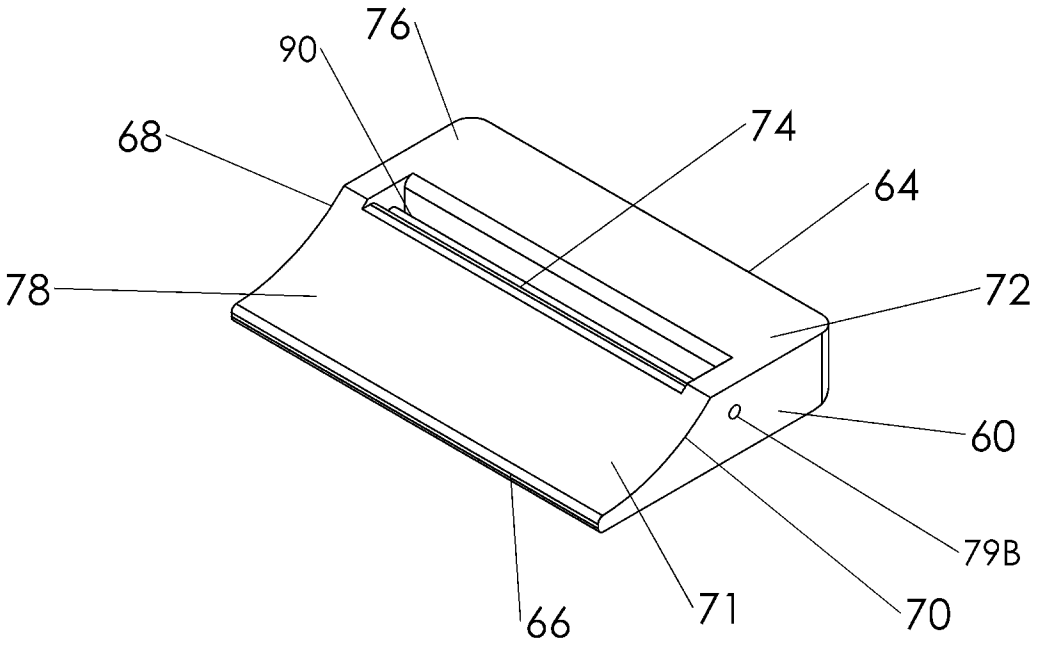
FIG. 12 is a perspective view of the locking member.
Figure 13:
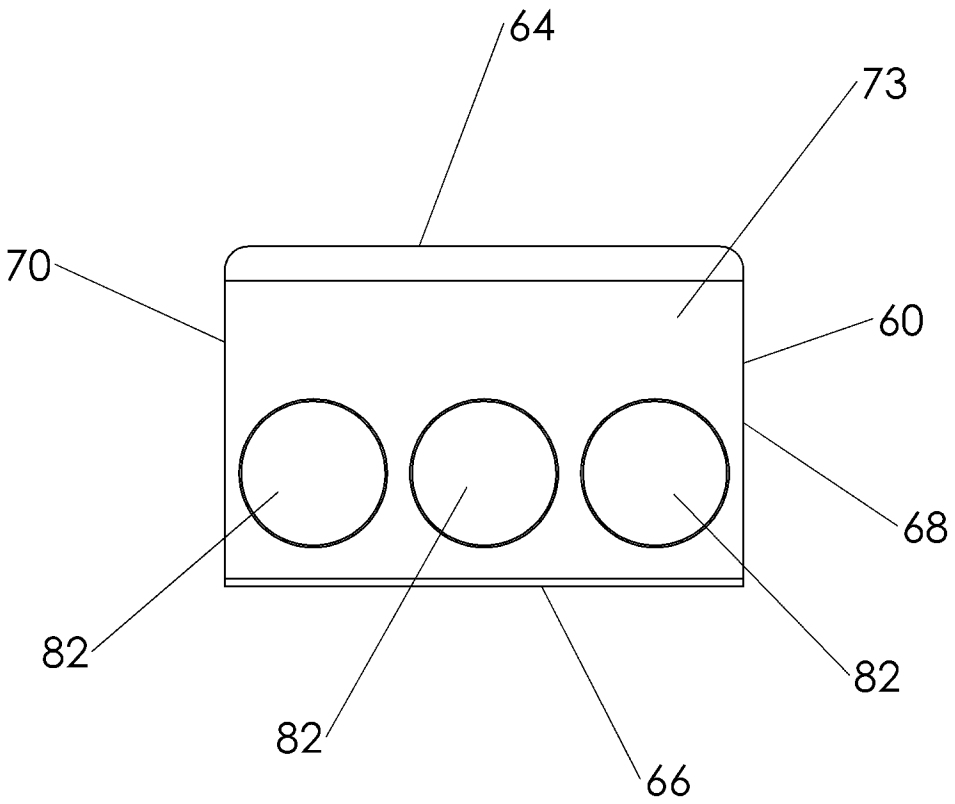
FIG. 13 is a bottom view of the locking member.

Referring to FIGS. 1, 2, 4 and 11, buckle 10 further comprises cap section 38 that is removably attached to the peripheral portion 20 of the first side 16 and positioned within the opening 18. Cap section 38 is sized to cover a portion of interior region 14 of buckle body 12. Cap section 38 is supported by ledge 37. In a preferred embodiment, cap section 38 is frictionally fitted between sidewalls 32 and 34. Cap section 38 includes first end 40. First end 40 is in proximity to and spaced apart from pin member 36 by a gap 42. Cap section 38 has second end 44 that is adjacent to peripheral portion 20. Cap section 38 has top side 46, bottom side 48, and structure 50 that extends form bottom side 48. Pin member 52 is attached to and supported by structure 50. As shown in FIG. 11, structure 50 comprises sections 51A, 51B and 51C. Sections 51A and 51B are parallel to each other and are joined to section 51C. Section 51C is substantially perpendicular to sections 51A and 51B. Pin member 52 is attached to sections 51A and 51B. In one embodiment, pin member 52 is integrally formed with sections 51A and 51B. In another embodiment, sections 51A and 51B are formed with openings 53A and 53B and pin member 52 is frictionally inserted into these openings.

Figure 15:
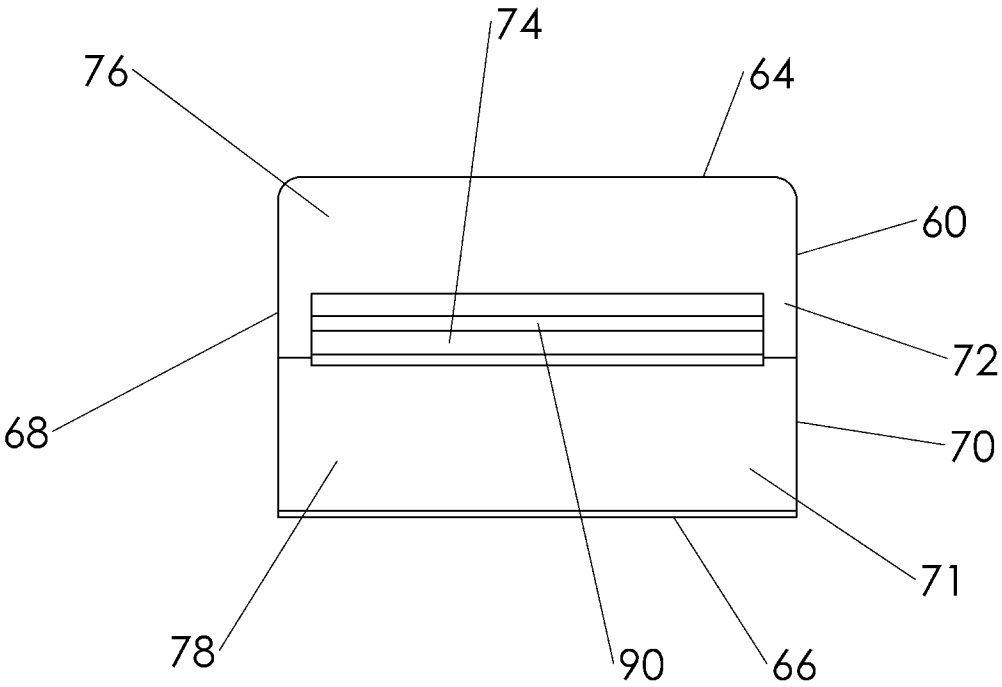
FIG. 15 is a top view of the locking member.
Figure 16:
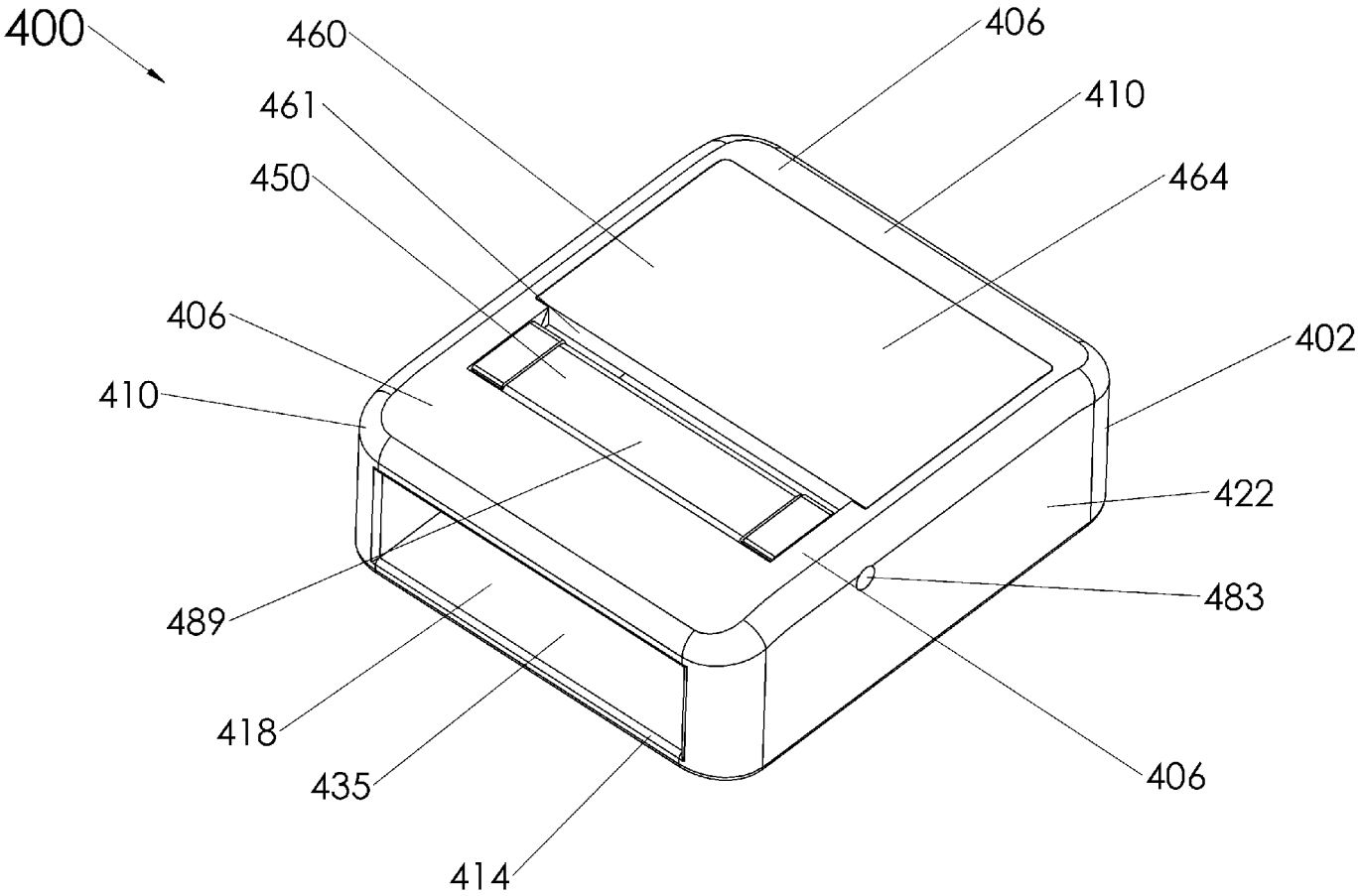
FIG. 16 is a perspective view of a belt buckle in accordance with another embodiment of the present invention.
Figure 17:
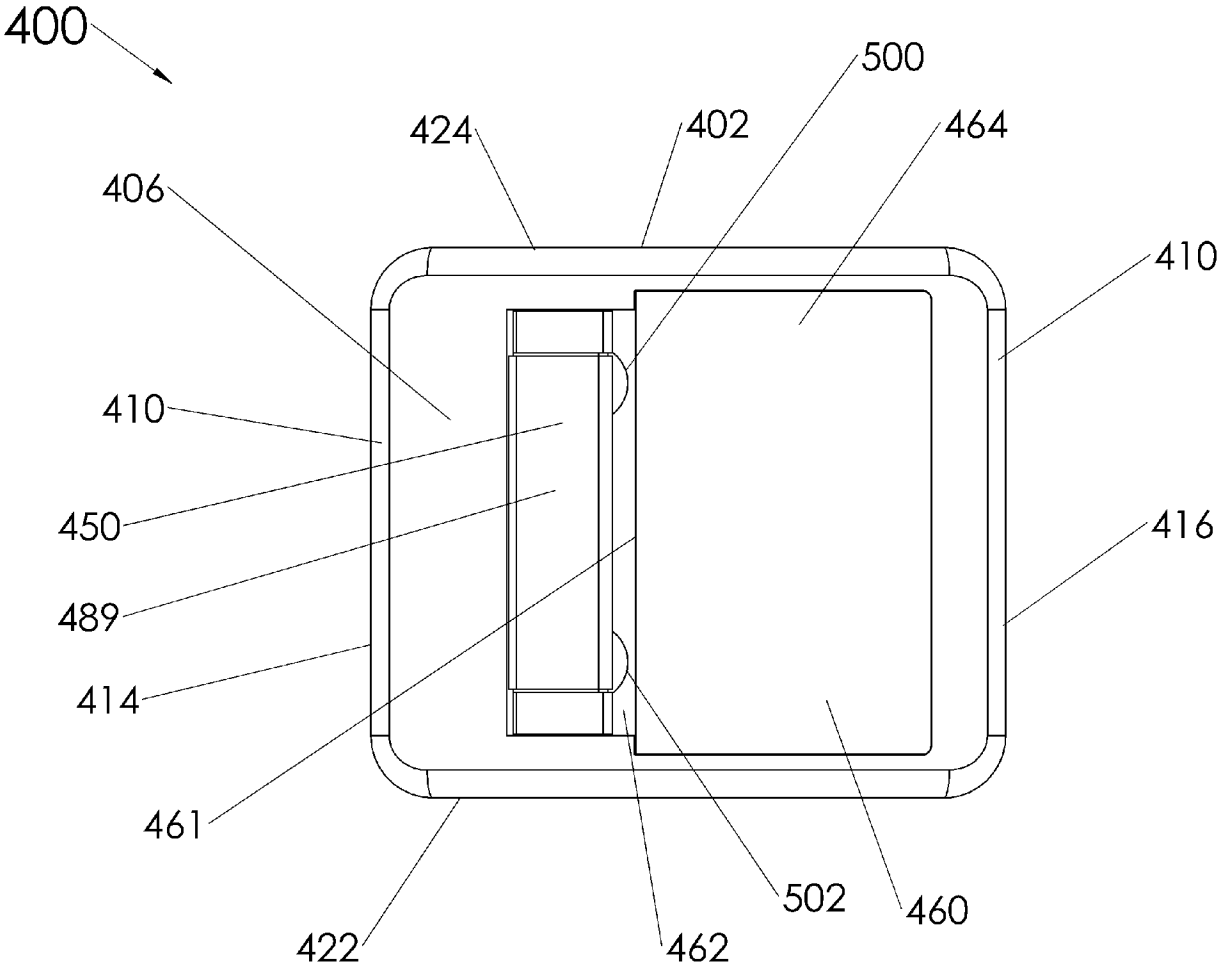
FIG. 17 is a top view of the belt buckle of FIG. 16.

Referring to FIGS. 1, 2, 4-10, 12, 13 and 15, buckle 10 further comprises locking member 60. Locking member 60 is movable between an opened position and a closed position. When a portion of belt section 204 is within the interior region 14 and free end 206 of belt extends from opening 28 in buckle end 24 and locking member 60 is in the closed position, the locking member 60 prevents movement of belt section 204 through buckle body 12. When locking member 60 is in the opened position, belt section 204 is able to be moved through buckle body 12. Specifically, when locking member 60 is in the opened position, belt section 204 can move freely through openings 28 and 30 in buckle ends 24 and 26, respectively. Locking member 60 comprises first end 64, second end 66, sidewalls 68 and 70, curved or sloping section 71, top side 72 and bottom side 73. First end 64 has a height that is substantially greater than the height of second end 66. Locking member 60 includes a laterally extending slot 74 that is substantially parallel to first end 64 and second end 66. Top side 72 comprises portion 76 that is between first end 64 and slot 74. Top side 72 further comprises sloping portion 78 that is part of curved section 71 (see FIGS. 4 and 12). At least one friction member 82 is attached to bottom side 73 for frictionally contacting a portion of belt section 204 that is within interior region 14. As shown in FIGS. 4 and 15, pin member 90 is positioned within slot 74 and attached to the sidewalls 68 and 70. In one embodiment, locking member 60 has openings 79A and 79B in sidewalls 68 and 70, respectively, which receive pin member 90. Pin member 90 is frictionally inserted through openings 79A and 79B.

Referring to FIGS. 4-7 and 10, belt buckle 10 further comprises tension band 100 which exhibits a degree of tension. Tension band 100 comprises first end 102 that is wrapped about pin member 52 and second end 104 that extends through gap 42 and into slot 74 wherein it is wrapped about pin member 90. Tension band 100 exerts constant tension on locking member 60 which urges locking member 60 to the open position such that when locking member 60 is in the open position: (i) curved section 71 is pulled against pin member 36, (ii) first end 64 of locking member 60 is completely external to interior region 14, and (iii) friction member 82 is oriented such that it does not face belt end 202 of belt 200. When a portion of intermediate belt section 204 is within interior region 14 and extends through opening 28 in buckle end 24 and locking member 60 is in the closed position, the first end 64 of locking member 60 is adjacent to peripheral portion 20 of buckle body 12, and bottom side 73 of locking member 60 is completely within interior region 14 so that friction member 82 frictionally contacts or engages the portion of intermediate belt section 204 that is within interior region 14, and curved section 71 is firmly positioned between pin member 36 and belt end 202. As the wearer or user moves locking member 60 to the closed position, the constant tension on tension band 100 pulls curves section 71 against pin member 36.

In order to move locking member 60 to the closed position, the wearer moves locking member 60 with sufficient force to overcome the tension on tension band 100. When a portion of intermediate belt section 204 is within interior region 14 such that free end 206 of belt extends from opening 28 in buckle end 24, movement in first direction 350 by any portion of the belt 200 that is external to interior region 14 produces force 400 (see FIG. 5) which breaks the frictional engagement between the friction member 82 and the portion of intermediate belt section 204 that is within interior region 14 thereby causing the friction member 82 to release the intermediate belt section 204 and allowing the tension on tension band 100 to pull locking member 60 to the open position.

Figure 6:
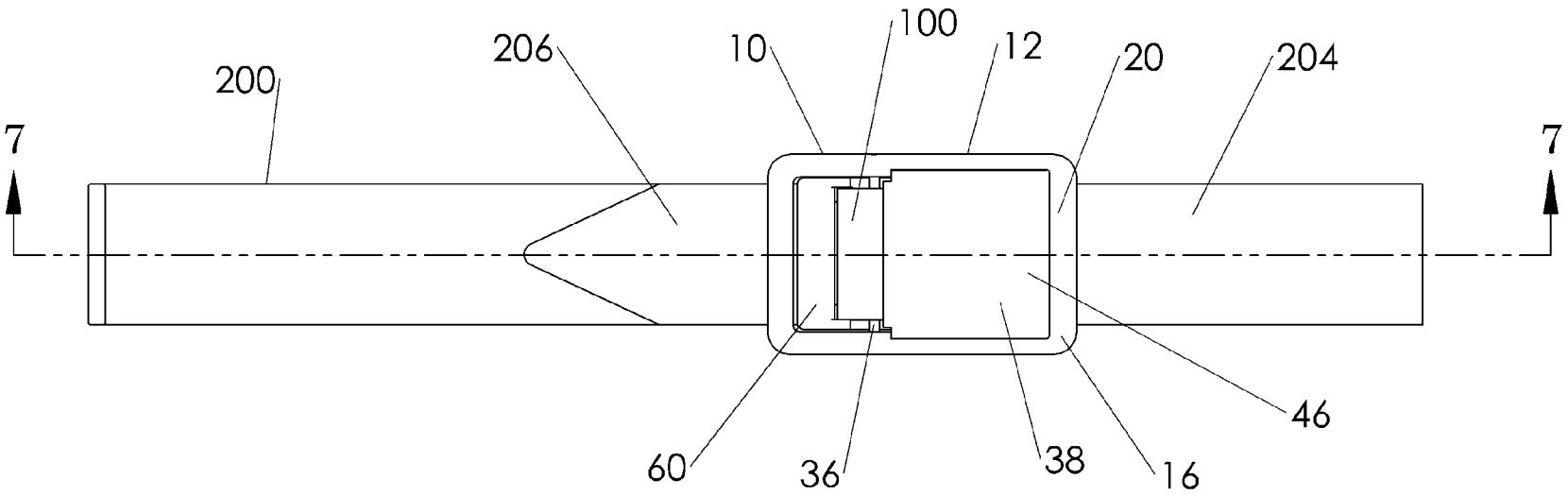
FIG. 6 is a front view of the belt buckle and the belt, the view showing a locking member, depicted in FIG. 1, being in a locked position.
Figure 7:
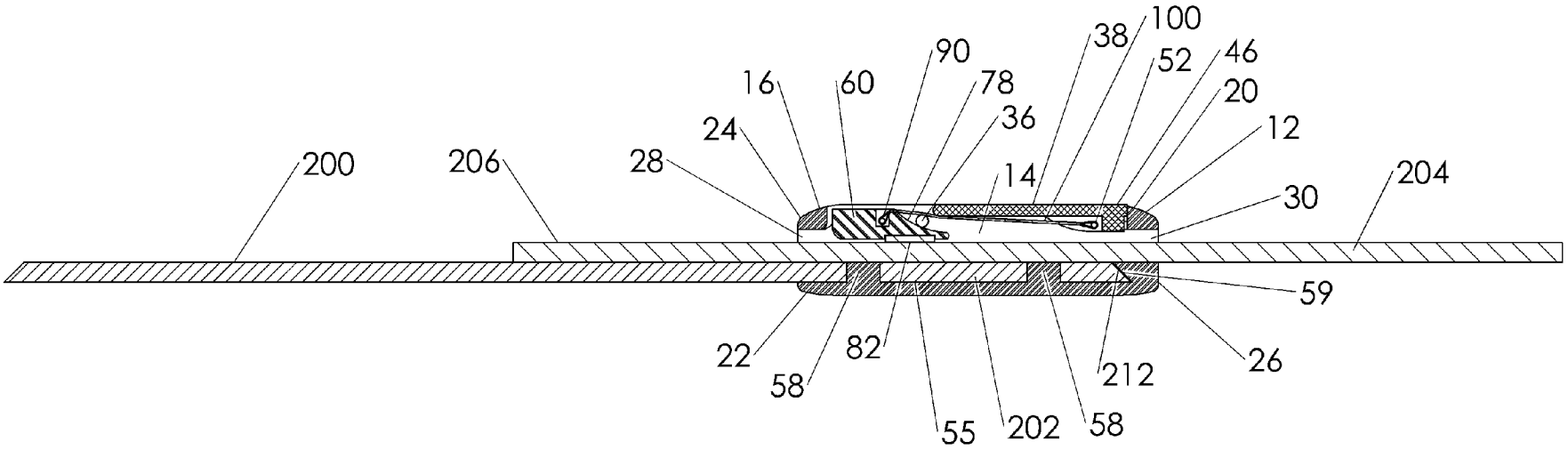
FIG. 7 is a cross-sectional view taken along line 7-7 in FIG. 6.
Figure 8:
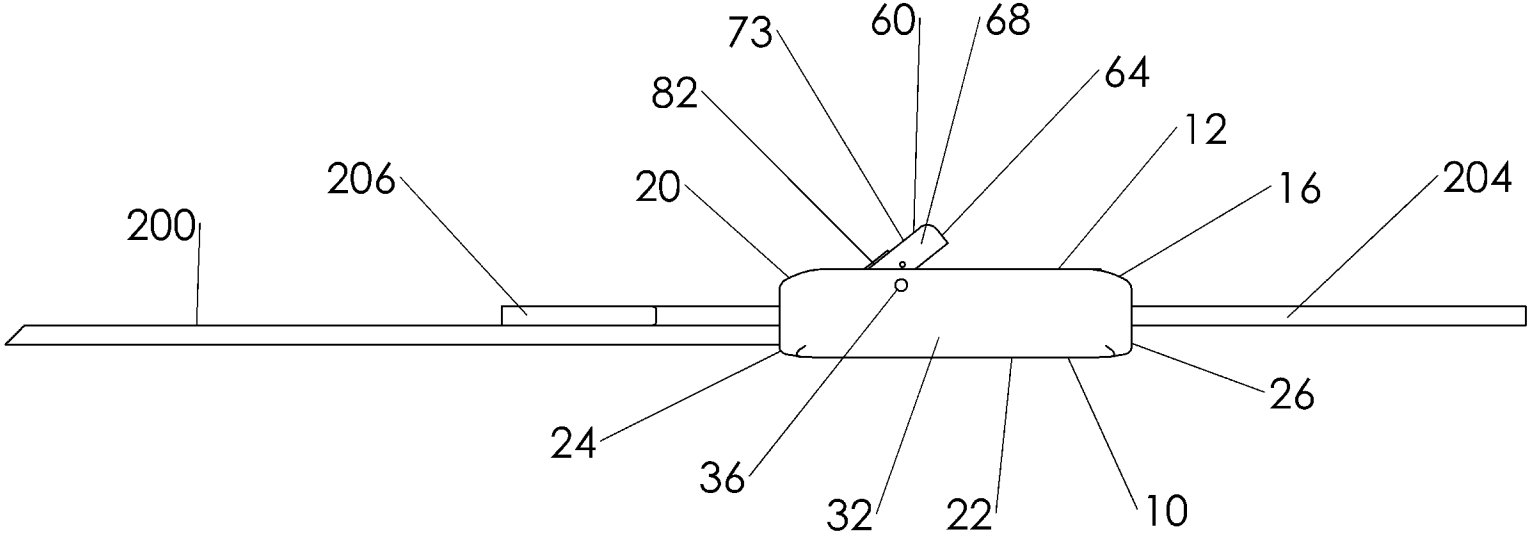
FIG. 8 is side view of the belt buckle and belt, the view showing the locking member in an open position.
Figure 9:
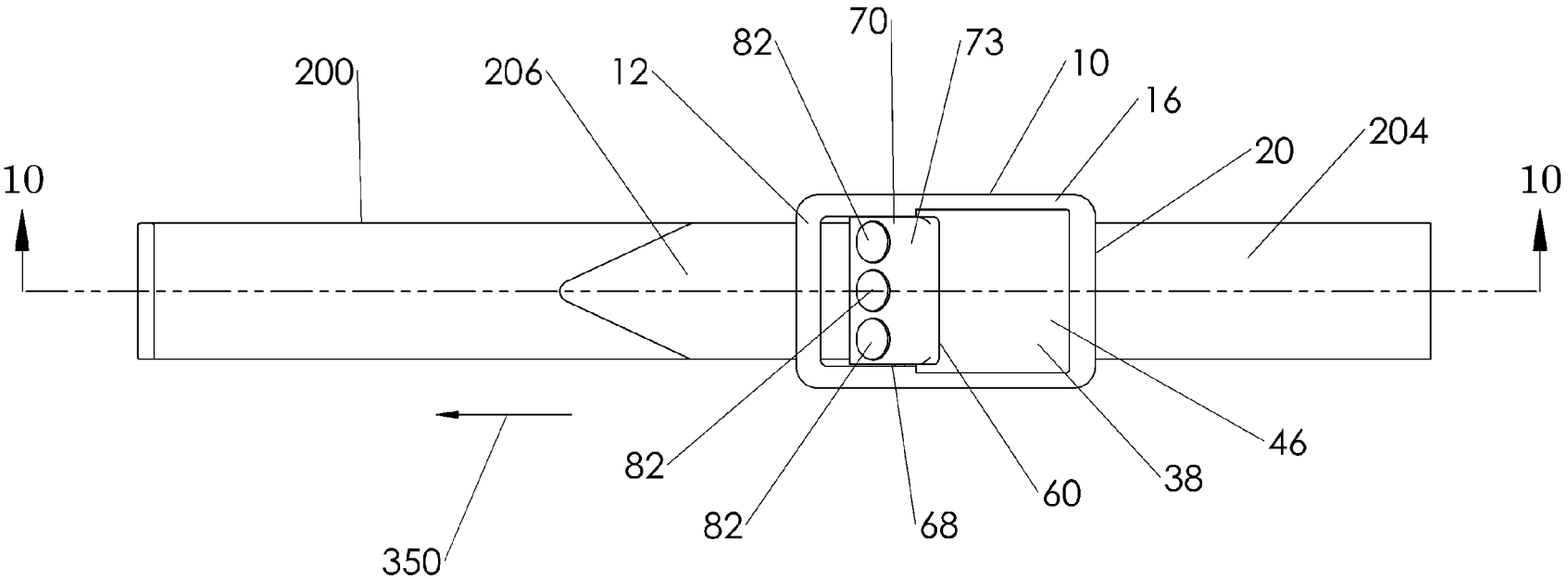
FIG. 9 is a top view of the belt buckle and belt, the view showing the locking member in the open position.

Referring to FIGS. 8-10, in order to use belt 200, the wearer or user wraps belt 200 around his or her waist. The wearer then inserts free end 206 of belt 200 through opening 30 in buckle end 26 and feeds intermediate belt section 204 through belt buckle 10 so that free end 206 exits opening 28 in buckle end 24. The wearer then grasps free end 206 and pulls it so that more of intermediate belt section 204 passes through belt buckle 10. When the wearer is comfortable with the tightness of belt 200 around his or her waist, the wearer then moves locking member 60 to the closed position as shown in FIGS. 5-7. Once locking member 60 is in the closed position, friction member 82 frictionally contacts the portion of intermediate belt section 204 that is within interior region 14 thereby preventing of movement of intermediate belt section 204 in second direction 352 (see FIG. 5). In order to remove belt 200 from the wearer's waist, the wearer then moves belt section 204 in first direction 350 to cause the friction member 82 to release the portion of intermediate belt section 204 within interior region 14 thereby enabling the tension on tension band 100 to pull locking member 60 to the open position. The wearer then pulls the belt section 204 in the second direction 352 until free end 206 of belt 200 exits opening 30 in buckle end 26.

Referring to FIGS. 16-26, there is shown belt buckle 400 in accordance with another embodiment of the present invention. Belt buckle 400 is used with belt 200 which was described in the foregoing description. Belt 200 comprises belt end 202, intermediate belt section 204 and free end 206. Belt end 202 is attached or secured to belt buckle 400. Belt buckle 400 comprises buckle body 402. Buckle body 402 comprises an interior region 404 and a first side 406 having an opening 408 that exposes the interior region 404. First side 406 comprises peripheral portion 410 that extends about first side 406. Buckle body 402 further comprises opposite, second side 412, first buckle end 414 and an opposite second buckle end 416. Buckle ends 414 and 416 have openings 418 and 420, respectively, which provide access to the interior region 404. Openings 418 and 420 and interior region 404 are sized to allow portions of belt 200 to pass therethrough. Buckle body 402 further comprises sidewalls 422 and 424 that are contiguous with the buckle ends 414 and 416. Sidewalls 422 and 424 include through-holes 425 for receiving pin member 483 (see FIG. 18A). Pin member 483 is attached or mounted to the sidewalls 422 and 424 and extends across the interior region 404. The purpose of pin member 483 is described in the ensuing description. Buckle body 402 includes rib or ledge 427 that is on the interior side of sidewalls 422 and 424 and buckle end 416 as shown in FIG. 18A. Rib or ledge 427 has notch 428. The purpose of ledge 427 is discussed in the ensuing description.

Figure 18A:
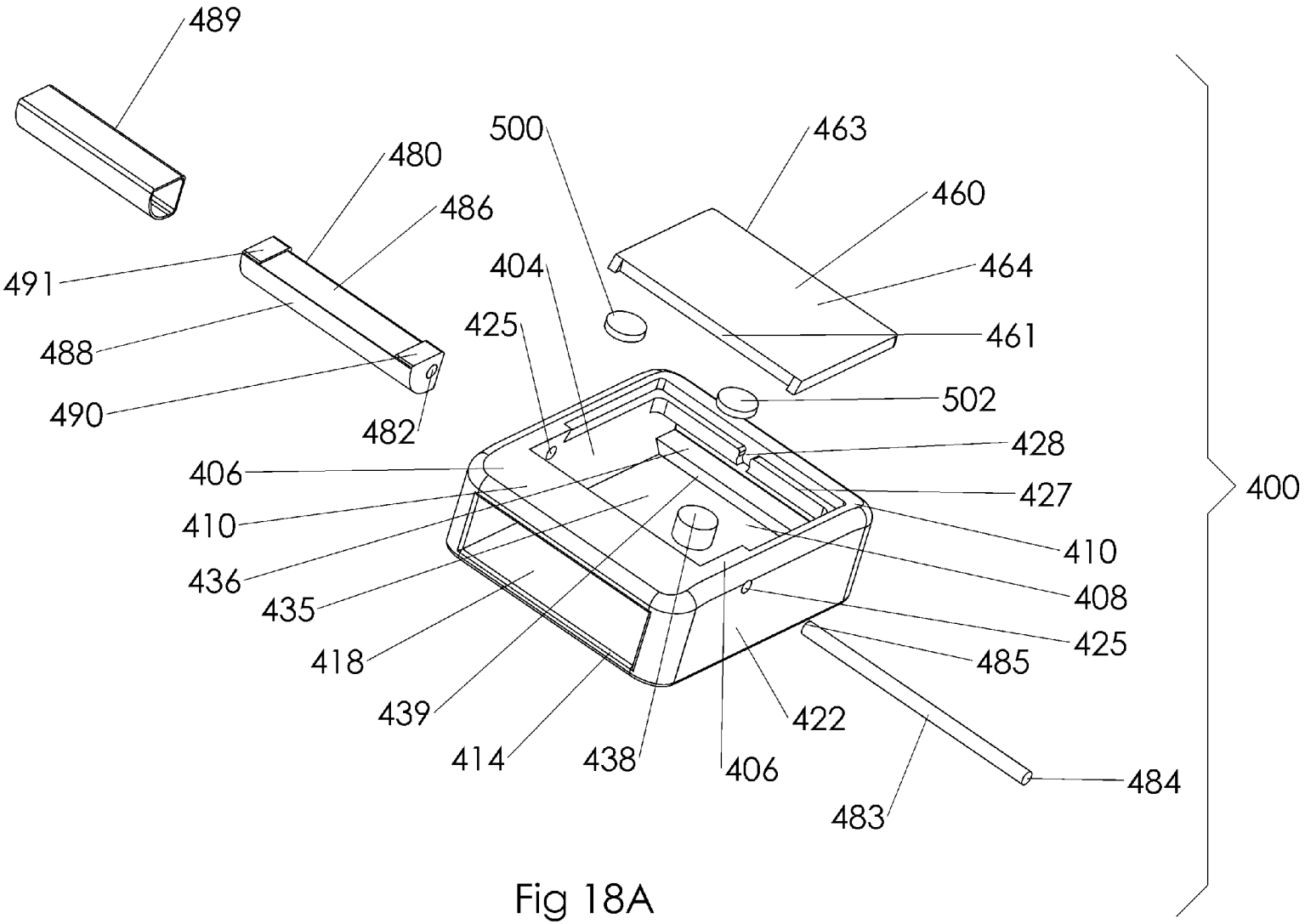
FIG. 18A is an exploded view of the belt buckle of FIG. 16.
Figure 18B:
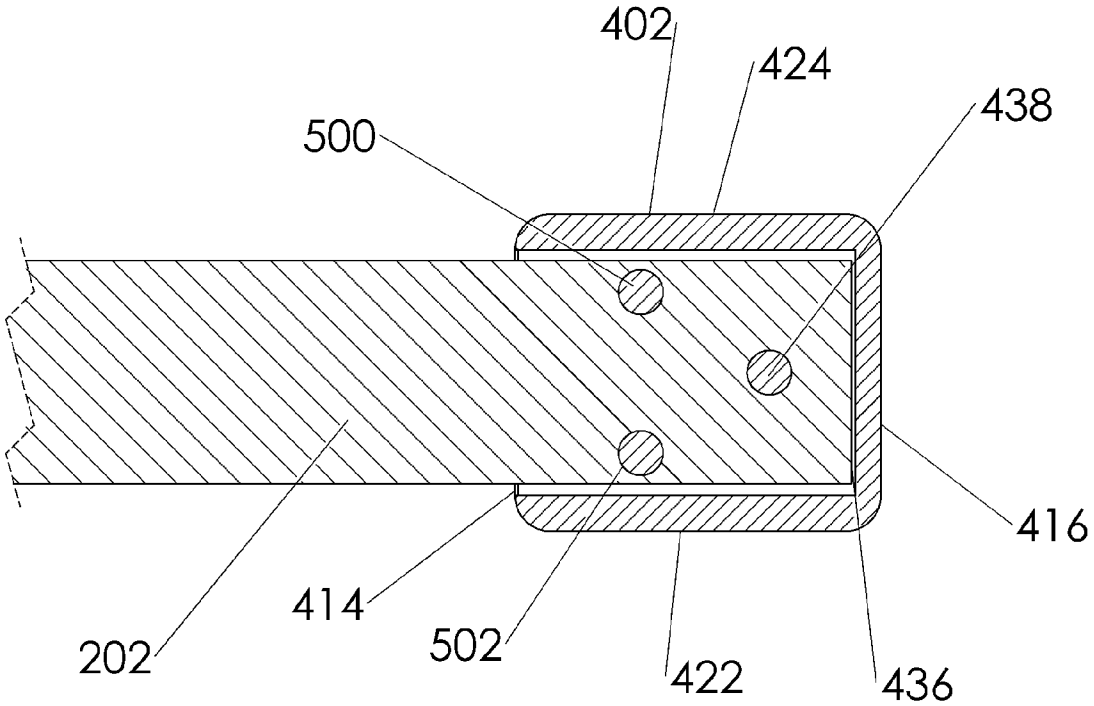
FIG. 18B is a top view, partially in cross-section, of the belt end that is secured to the bottom, interior surface of the belt buckle body, the view showing friction pads that are attached to the bottom, interior surface of the belt buckle body and positioned within corresponding openings in the belt end.
Figure 20:
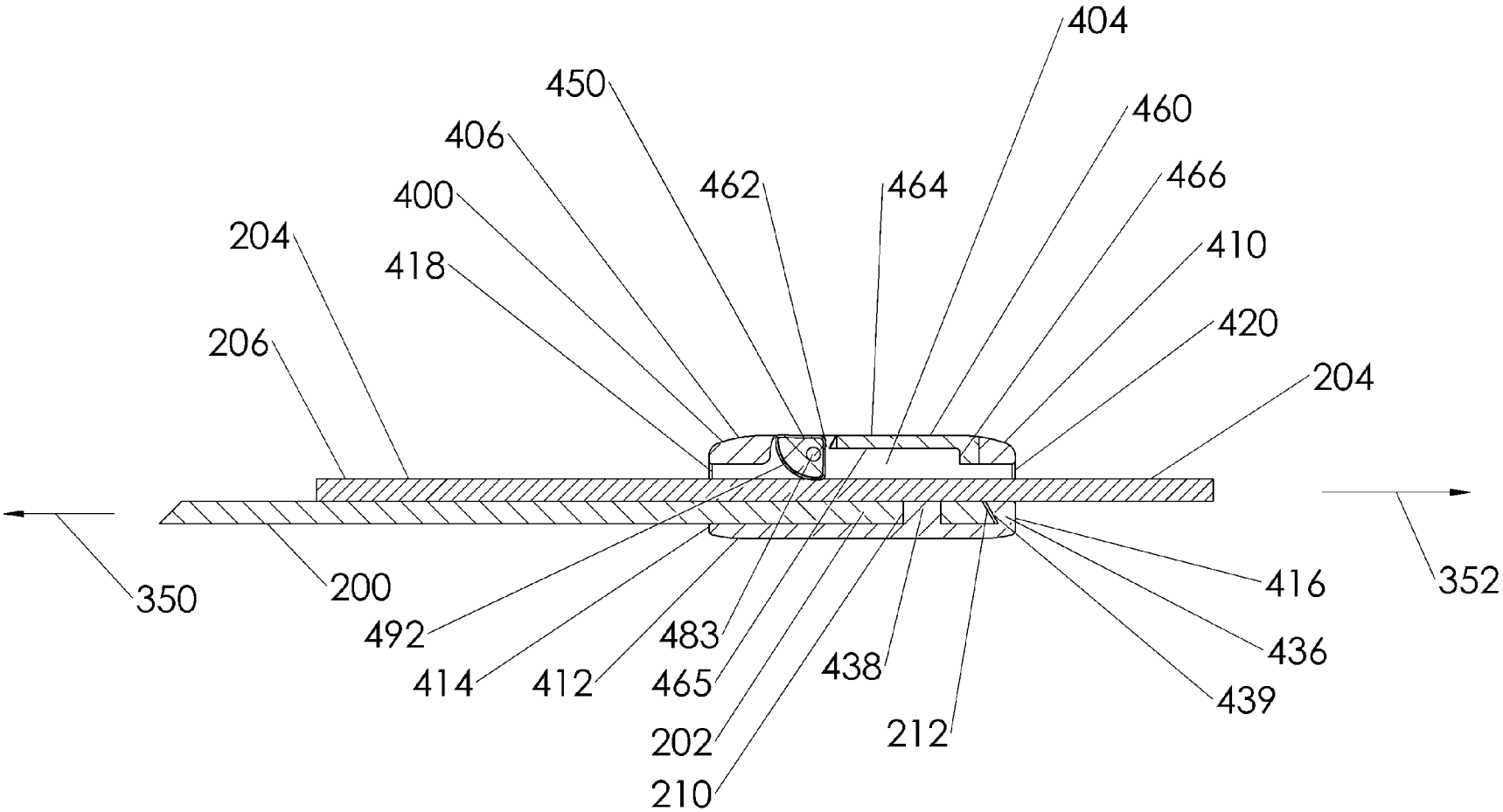
FIG. 20 is a cross-sectional view taken along line 20-20 in FIG. 19, the view showing a pivoting member in a first position wherein the pivoting member contacts the movable belt section.

Referring to FIGS. 18A, 18B and 20, the structure of the interior, bottom portion of buckle body 402 is similar to the structure of the interior, bottom portion of buckle body 12. Specifically, buckle body 402 further comprises interior bottom surface 435, wall 436 and upstanding tabs or protruding members 438 that upwardly extend from interior bottom surface 435. Upstanding tabs 438 have the same shape and function as upstanding tabs 58 shown in FIG. 10. In a preferred embodiment, there are two upstanding tabs 438. Wall 436 has generally the same structure as wall 56 shown in FIG. 10. Wall 436 includes angled portion 439 located within interior region 404. Angled portion 439 has the same shape and function as angled portion 59 of interior wall 56 (see FIG. 10). Belt end 202 is positioned within interior region 404 and attached to buckle body 402. Belt end 202 has through-hole 210 and an angled edge 212. Upstanding tabs 438 are frictionally inserted into corresponding through-holes 210 and angled edge 212 is fitted under angled portion 439 of wall 436. In an alternate embodiment, an adhesive is also used to attach belt end 202 to interior bottom surface 435.

Figure 20A:
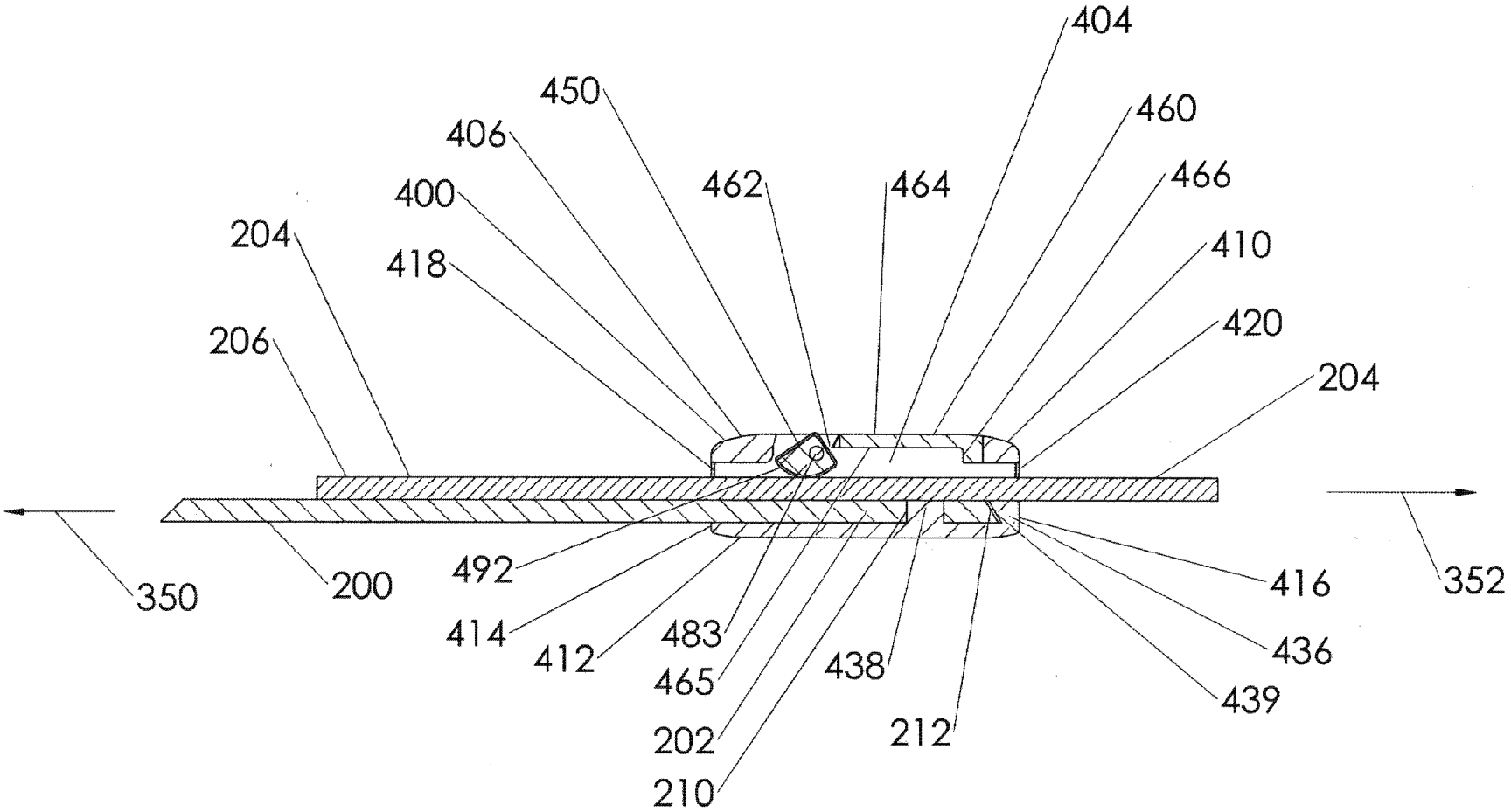
FIG. 20A is a view similar to FIG. 20 and shows the position of the pivoting member resulting from tension on the belt.
Figure 21:
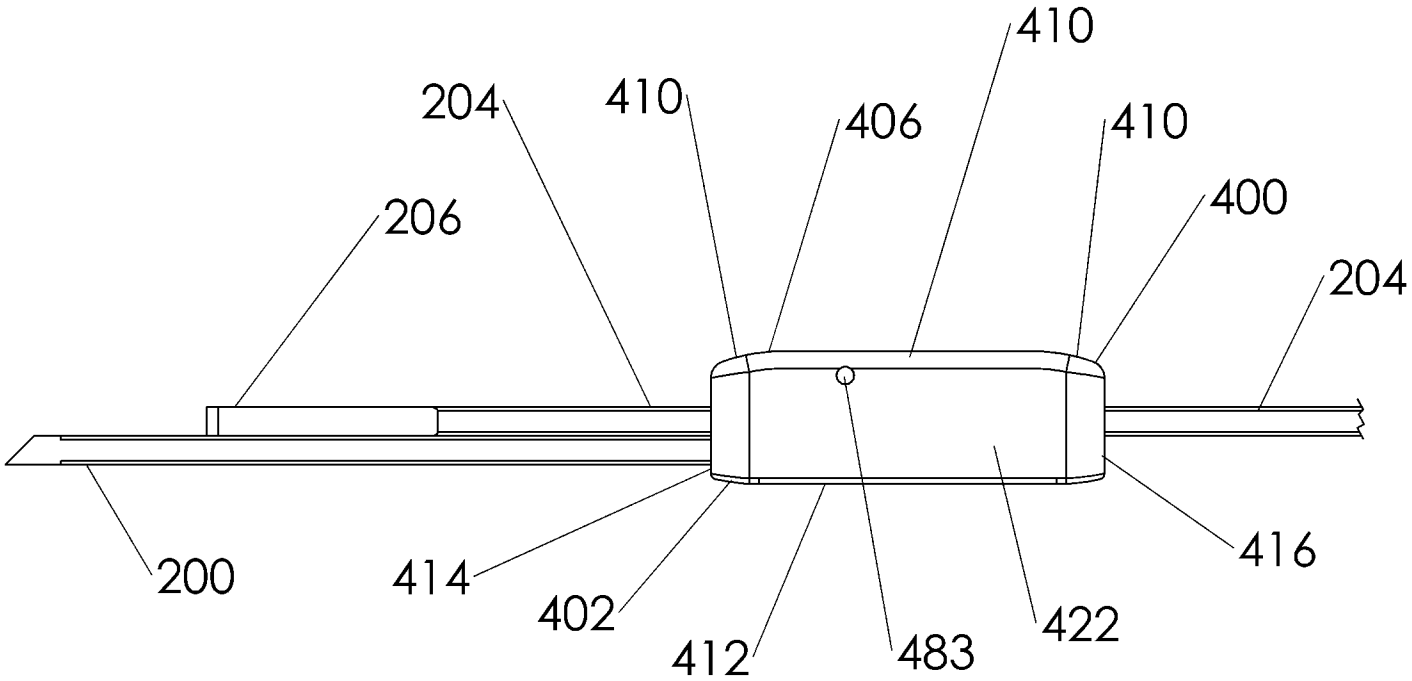
FIG. 21 is a side view of the belt buckle and belt shown in FIG. 19.

Referring to FIGS. 18C, 19, 20, 20A and 22, buckle 400 further comprises pivoting member 450. Pivoting member 450 can pivot in a first direction to a first position, shown in FIGS. 18C and 20, wherein the pivoting member 450 contacts belt section 204. Pivoting member 450 can also pivot in a second, opposite direction to a second position, shown in FIG. 22, wherein there is no physical contact between pivoting member 450 and belt section 204. The structure and function of pivoting member 450 is described in detail in the ensuing description. When free end 206 of belt 200 is inserted through opening 420 and interior region 404 and extends from opening 418 and pivoting member 450 is in the second position, the wearer may move belt section 204 in direction 350 to tighten of belt 200 around the wearer's waist and may move belt section 204 in opposite direction 352 to loosen belt 200. Thus, when pivoting member 450 is in the second position, the wearer may move belt section 204 through belt buckle 400 in either direction 350 and 352. When pivoting member 450 is pivoted in the first direction to the first position, the pivoting member 450 contacts the belt section 204. When a tensile force or tension is on belt 200, pivoting member 450 is pulled downward as shown in FIG. 20A. When pivoting member 450 is in this position, there is firm and frictional contact between pivoting member 450 and belt section 204 which prevents belt section 204 from moving in direction 352. This firm and frictional contact between pivoting member 450 and belt section 204 cooperates with the unique shape and structure of pivoting member 450 to prevent movement of belt section 204 in direction 352. Thus, belt 200 cannot become loose around the wearer's waist when pivoting member 450 is in the position shown in FIG. 20A.

When pivoting member 450 is in the first position or in the position shown in FIG. 20A and the wearer desires to position pivoting member 450 to the second position, the wearer moves belt section 204 in direction 350. Due to the frictional contact between pivoting member 450 and belt section 204, the movement of belt section 204 in direction 350 causes pivoting member 450 to pivot in the second, opposite direction to the second position. When pivoting member 450 is in the second position, there is clearance between pivoting member 450 and belt section 204 which allows the wearer to move belt section 204 in direction 350 to tighten belt 200 or in direction 352 in order to loosen belt 200. Once the wearer is satisfied with the tightness of belt 200, the wearer uses his or her finger to pivot pivoting member 450 in the first direction to the first position wherein pivoting member 450 contacts belt section 204. Then, the wearer's body and clothing produce tensile stress or tension on belt 200 thereby causing pivoting member 450 to be pulled downward to the position shown in FIG. 20A.

Referring to FIGS. 16-19, belt buckle 400 further comprises cover 460 that is removably attached to the buckle body 402. Specifically, cover 460 is removably and frictionally mounted to peripheral portion 410 and located within opening 408. Cover 460 is sized to cover a portion of interior region 404 of buckle body 402. Cover 460 is supported by ledge 427. Cover 460 includes front end 461. Front end 461 is in proximity to and spaced apart from pivoting member 450 by gap 462. Cover 460 has rear end 463 that is adjacent to peripheral portion 410. Cover 460 has top side 464, bottom side 465, and structure 466 that extends from bottom side 465. In one embodiment, structure 466 has the same shape, configuration and geometry as that of structure 50 of cap section 38 which was described in the foregoing description and shown in FIG. 11. Structure 466 includes a tab (not shown) which is sized to fit into notch 428 in ledge 427 (see FIG. 18A).

Figure 23:
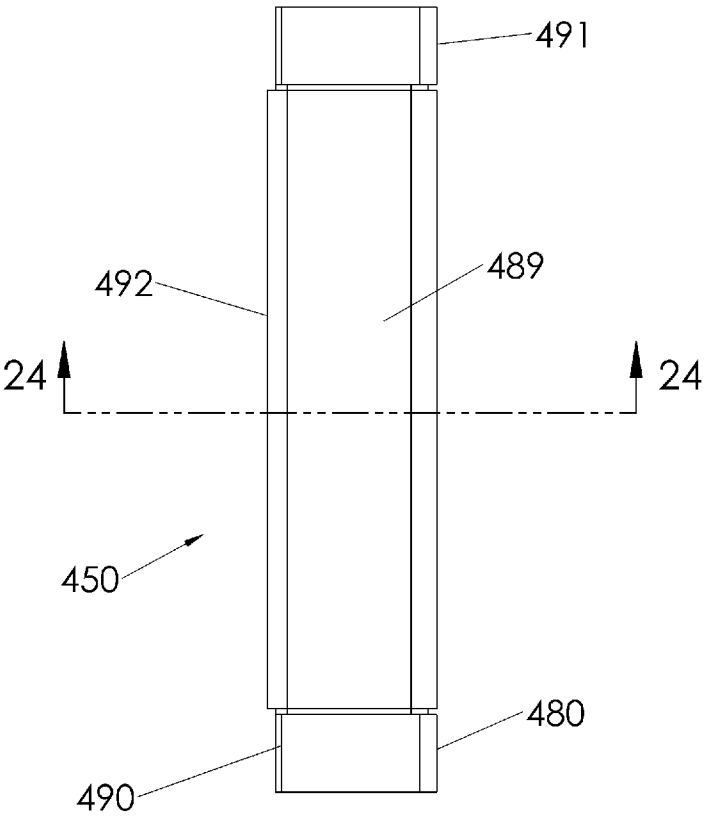
FIG. 23 is a top view of the pivoting member depicted in FIGS. 18C, 20, 20A and 22.
Figure 24:
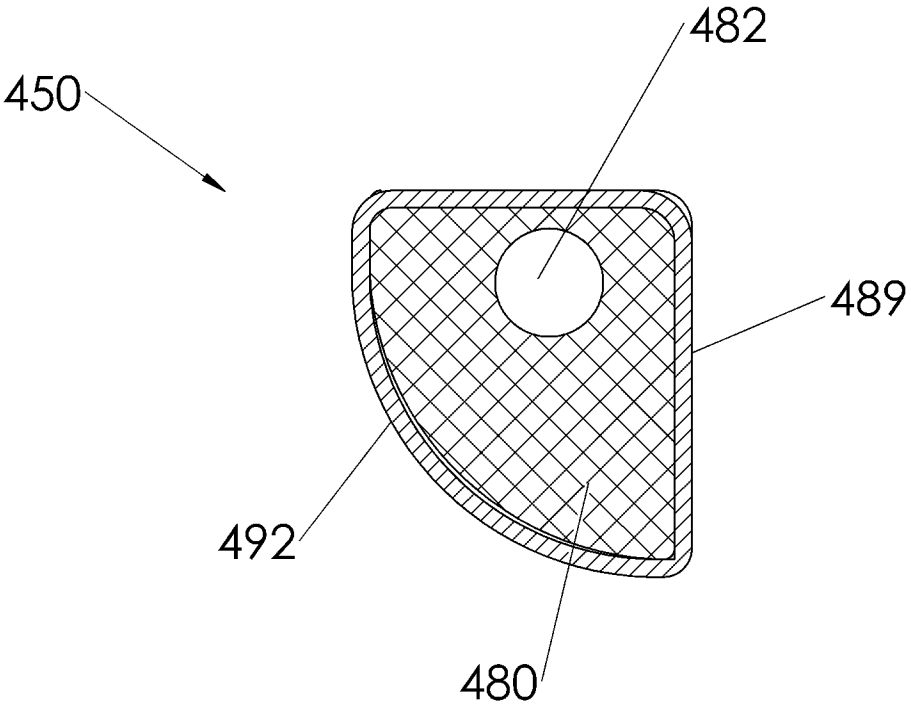
FIG. 24 is a cross-sectional view taken along line 24-24 in FIG. 23.
Figure 25:
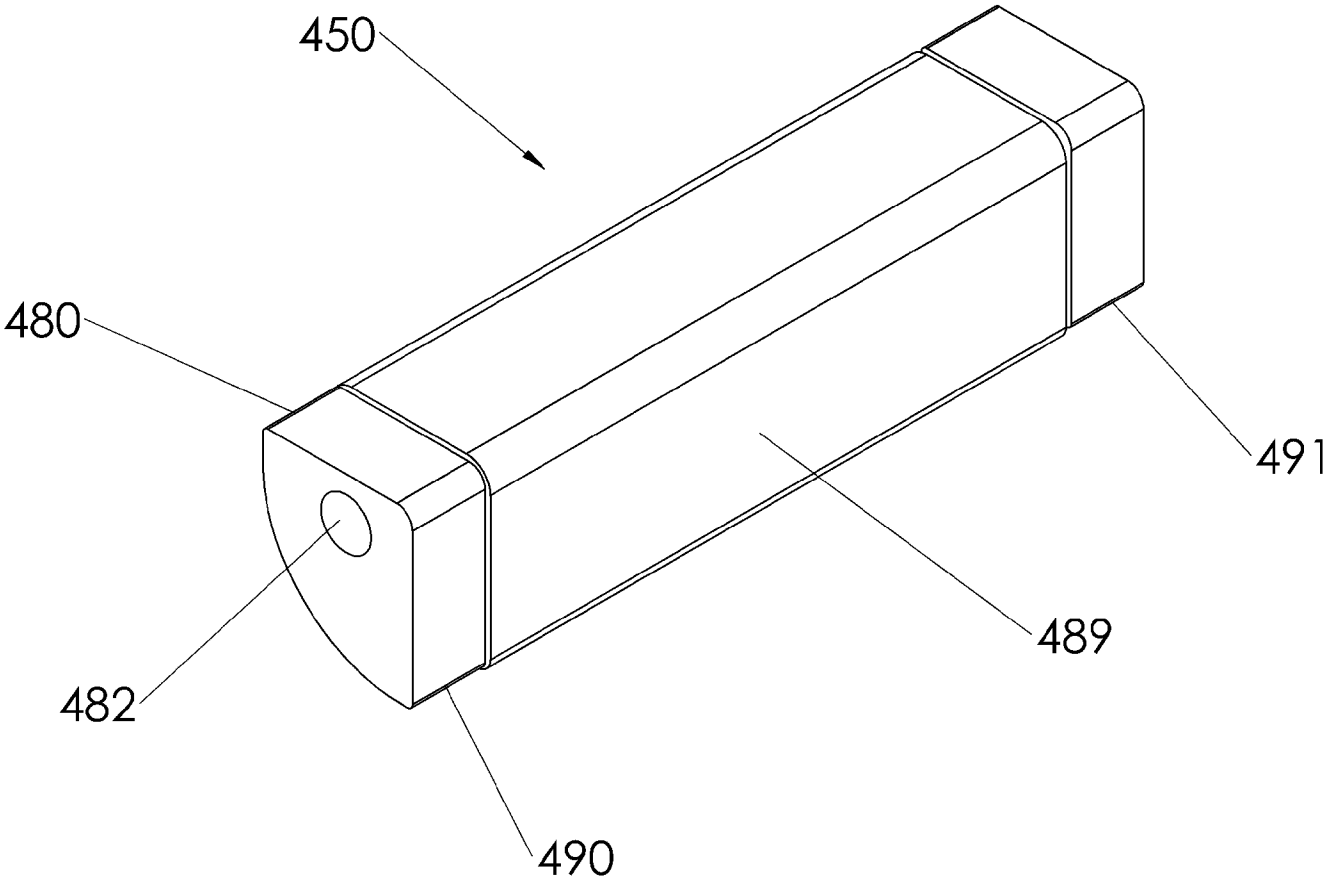
FIG. 25 is a perspective view of the pivoting member.
Figure 26:
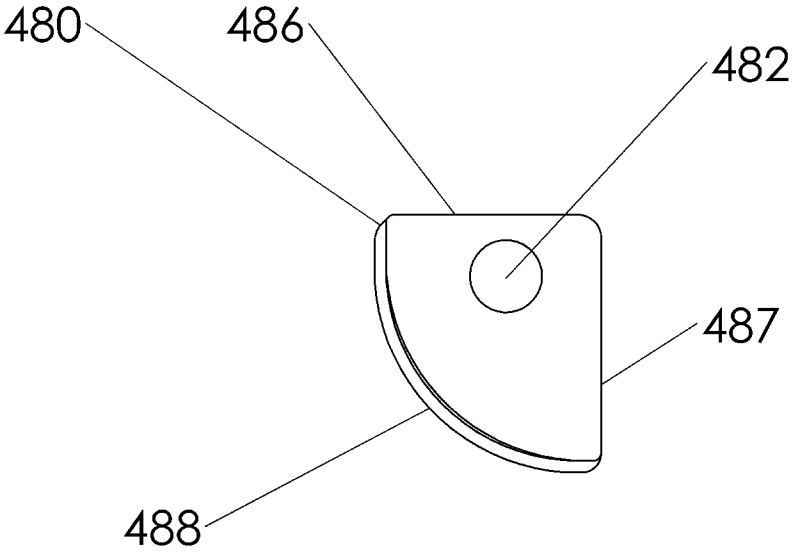
FIG. 26 is an end view of the pivoting member.

Referring to FIGS. 22-25, pivoting member 450 comprises body section 480. Body section 480 has a longitudinally extending bore 482. Pivoting member 450 further comprises pin member 483 that is disposed within bore 482. Pin member 483 has ends 484 and 485 that are frictionally inserted into openings 425 in sidewalls 422 and 424. In a preferred embodiment, pin member 483 does not rotate. The pivoting member 450 can pivot about the pin member 483 in the first direction and in the opposite second direction. Body section 480 comprises generally flat sides 486 and 487, and curved side 488. Curved side 488 is contiguous with generally flat sides 486 and 487. Pivoting member 450 further comprises sleeve 489. Sleeve 489 is fabricated from a material having a relatively high coefficient of friction such as rubber. Other suitable materials may be used to fabricate sleeve 489. Body member 480 is frictionally disposed within sleeve 489. As shown in FIG. 25, body member 480 has sections 490 and 491 that are not covered by sleeve 489. The curved side 488 of body member 480 provides pivoting member 450 with a curved exterior side 492. When pivoting member 450 is in the position shown in FIG. 20A, curved exterior side 492 firmly and frictionally contacts belt section 204.

Figure 22:
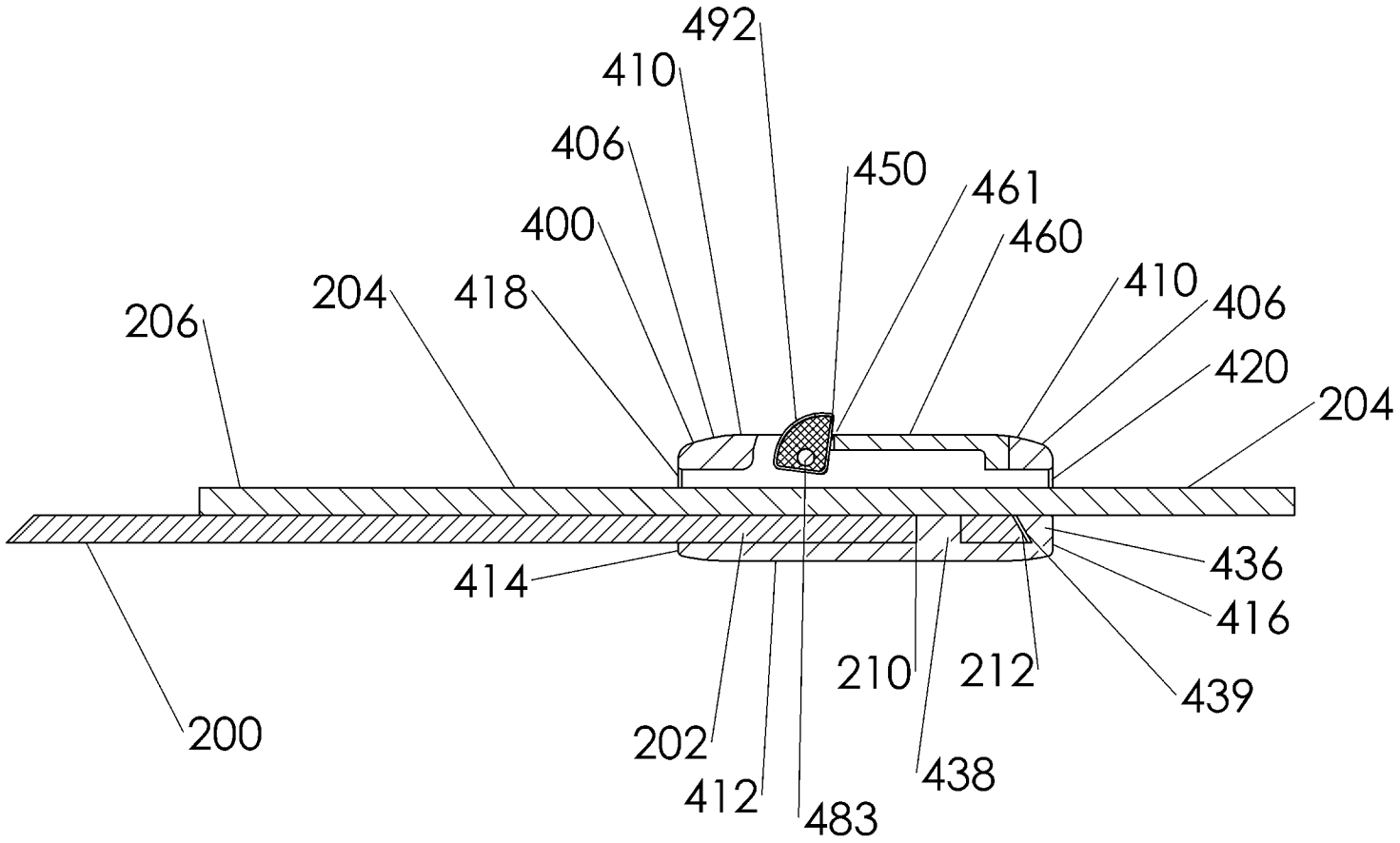
FIG. 22 is another cross-sectional view of the belt and belt buckle shown in FIG. 19, the view being similar to the view of FIG. 20 but instead shows the pivoting member in a second position wherein the pivoting member does not physical contact the movable belt section.

Referring to FIG. 20A, belt section 204 is within interior region 404 and free end 206 of belt 200 extends from opening 418 in buckle end 414. Tensile forces or stress on belt 200 produce a downward pulling force on pivoting member 450 which causes curved exterior side 492 to firmly and frictionally contact the portion of belt section 204 that is within interior region 404. Specifically, it is sleeve 489 that firmly and frictionally contacts or engages the portion of belt section 204. Due to the shape, size, structure and configuration of pivoting member 450, belt section 204 cannot be pulled in direction 352 when pivoting member 450 is in the position shown in FIG. 20A. In order to position pivoting member 450 to the second position, the wearer moves belt section 204 in direction 350. Due to the frictional contact between pivoting member 450 and belt section 204, the movement of belt section 204 in direction 350 pivots the pivoting member 450 to the second position as shown in FIG. 22. The wearer may then move belt section 204 in either direction 350 or direction 352.

Figure 18C:
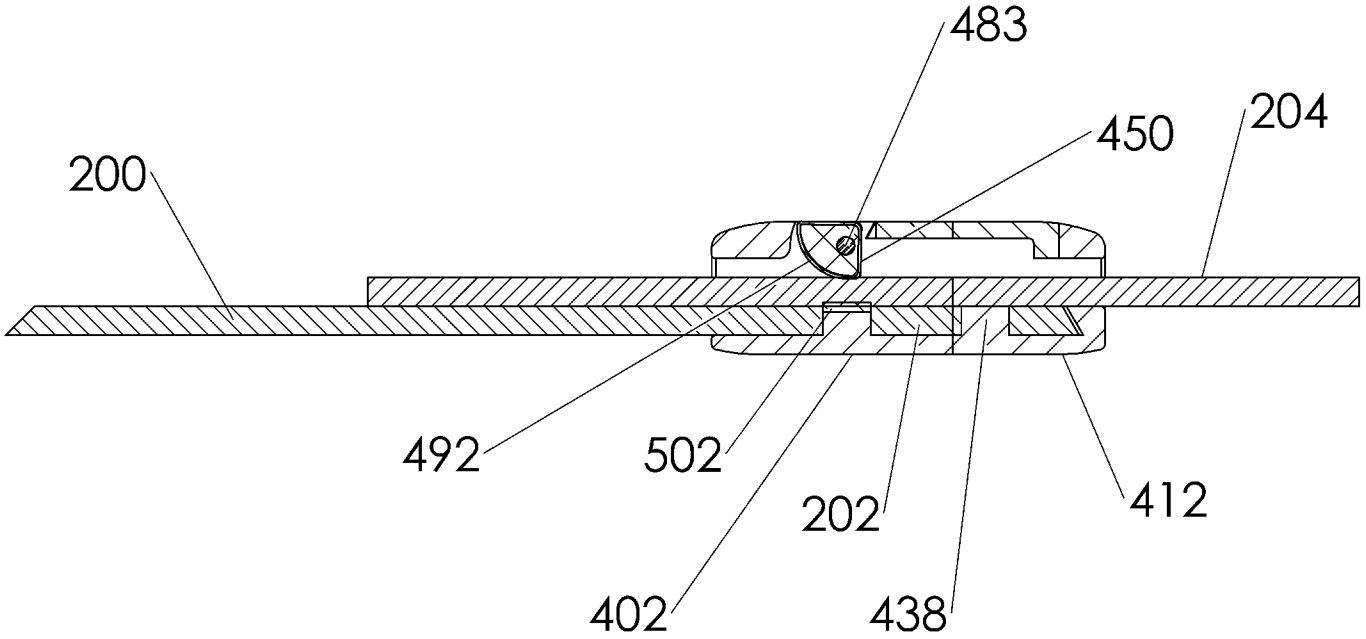
FIG. 18C is a partial side view, in cross-section, showing the belt end secured to the bottom portion of the belt buckle body, the friction pads positioned within the corresponding openings of the belt end, the movable belt section disposed over the belt end, and the pivoting member positioned in a first position wherein the pivoting member contacts the movable belt section.
Figure 19:
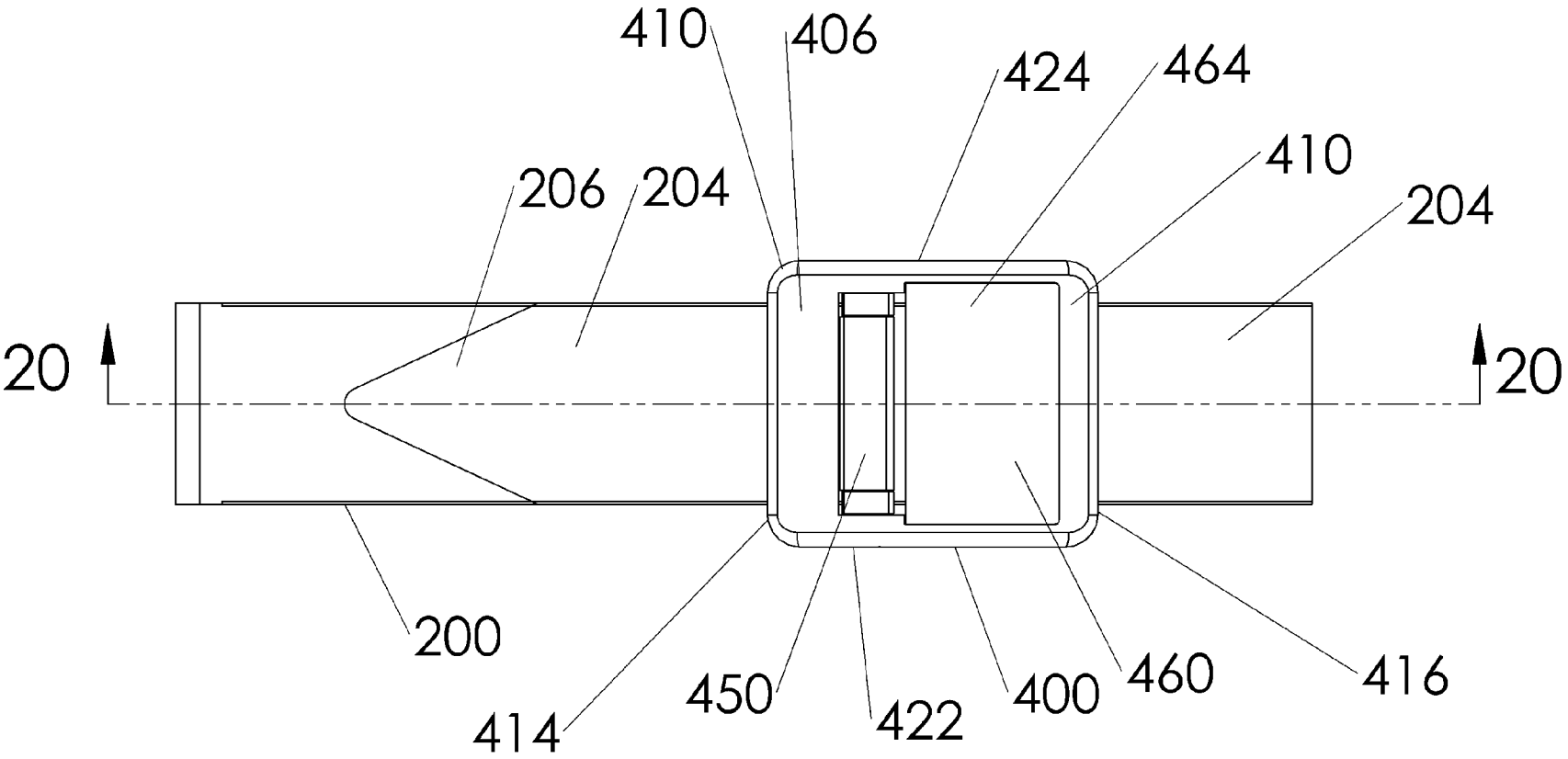
FIG. 19 is a top view of the belt buckle of FIG. 16 and a belt that is engaged with the belt buckle.

In order to use belt 200, the wearer or user wraps belt 200 around his or her waist. The wearer then inserts free end 206 of belt 200 through opening 420 in buckle end 416 and feeds intermediate belt section 204 through belt buckle 400 so that free end 206 exits opening 418 in buckle end 414. Since the wearer is moving the belt section 204 in direction 350, the pivoting member 450 will be pivoted to the second position as shown in FIG. 22. The wearer continues to pull more of intermediate belt section 204 through belt buckle 400 until the wearer is comfortable with the tightness of belt 200 around his or her waist. Once the wearer is comfortable with the tightness of belt 200 around his or her waist, the wearer stops pulling belt section 204 through belt buckle 400 and then pivots the pivoting member 450 in the first direction to the first position as shown in FIGS. 18C and 20 so that pivoting member 450 makes contact with belt section 204. The wearer's waist and clothing create tensile forces or tension on belt 200 which cause pivoting member 450 to be pulled downward as shown in FIG. 20A. Once pivoting member 450 is in the position shown in FIG. 20A, the pivoting member 450 makes firm and frictional contact with belt section 204 thereby preventing belt section 204 from moving in direction 352.

As shown in FIGS. 23, 24 and 25, sleeve 489 is tightly positioned on body member 480 and covers all of body member 480 except sections 490 and 491. In one embodiment, body member 480 is shaped and configured so that sleeve 489 is flush with sections 490 and 491. Such a configuration allows for clearance between pivoting member 450 and belt section 204 when pivoting member 450 is in the second position. In another embodiment, body member 480 is configured to have a longitudinally extending recessed area that extends over curved side 488 and is located between sections 490 and 491. In such an embodiment, sleeve 489 is positioned about body member 480 wherein a portion of sleeve 489 is positioned within the recessed area on curved side 488. The portion of sleeve 489 that is within the recessed area is flush with portions of sections 490 and 491 that are on curved surface 488. Such a configuration allows for a clearance between pivoting member 450 and belt section 204 when pivoting member 450 is in the second position. In another embodiment, body member 480 is shaped and configured so that sleeve 489 is not flush with sections 490 and 491. In such an embodiment, there is slight physical contact between pivoting member 450 and belt section 204 when pivoting member 450 is in the second position.

Referring to FIGS. 18A, 18B and 18C, in one embodiment of the invention, belt buckle 400 includes friction pads 500 and 502 that are fixed or attached to bottom surface 435 of buckle body 402. In one embodiment, friction pads 500 and 502 are adhered to bottom surface 435. In one embodiment, friction pads 500 and 502 are fabricated from rubber. Friction pads 500 and 502 are frictionally fitted within corresponding openings in belt end 202. As shown in FIG. 18C, friction pads 500 and 502 are substantially aligned with pivoting member 450. In one embodiment, friction pads 500 and 502 are aligned with pin member 483. Movable belt section 204 is disposed over belt end 202. The function of friction pads 500 and 502 is to receive the force created when pivoting member 450 firmly and frictionally contacts belt section 204. When pivoting member 450 firmly and frictionally contacts belt section 204, the force produced by the frictional contact causes the portion of belt section 204 directly under pivoting member 450 to be pressed against friction pads 500 and 502, not belt end 202. Such a configuration ensures that the frictional contact between pivoting member 450 and belt section 204 remains firm and tight throughout many uses of belt 200 and belt buckle 400. It is to be understood that the use of pad members 500 and 502 is an option and is not required in belt buckle 400.

In an alternate embodiment, pivoting member 450 is configured to provide a relatively light degree of physical contact between pivoting member 450 and belt section 204 when pivoting member 450 is in the second position. Thus, in such an alternate embodiment, there is no clearance between pivoting member 450 and belt section 204 when pivoting member 450 is in the second position. In such an alternate embodiment, the light degree of physical contact between pivoting member 450 and belt section 204 when pivoting member 450 is in the second position does not impede movement of belt section 204 through buckle 400 in direction 350. However, the light degree of physical contact between pivoting member 450 and belt section 204 when pivoting member 450 is in the second position is sufficient to cause pivoting member 450 to pivot to the first position if belt section 204 moves in direction 352. In order for a wearer to move belt section 204 in direction 352 to either loosen belt 200 or remove belt 200, the wearer must hold pivoting member 450 in the second position. Once the wearer releases pivoting member 450, any movement of belt section 204 in direction 352 will cause pivoting member 450 to pivot to the first position.

Figure 27:
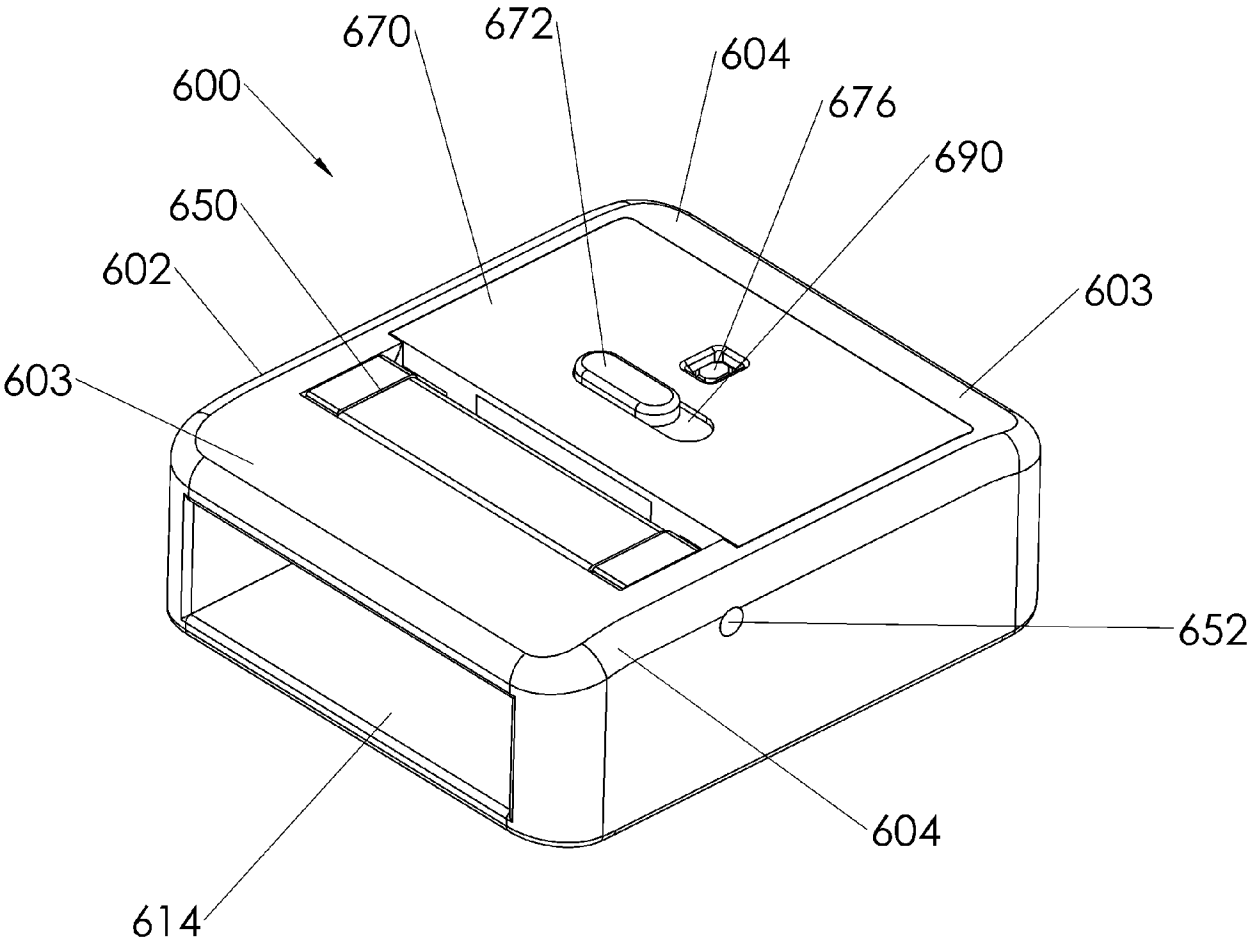
FIG. 27 is a perspective of a belt buckle in accordance with a further embodiment of the present invention.
Figure 28:
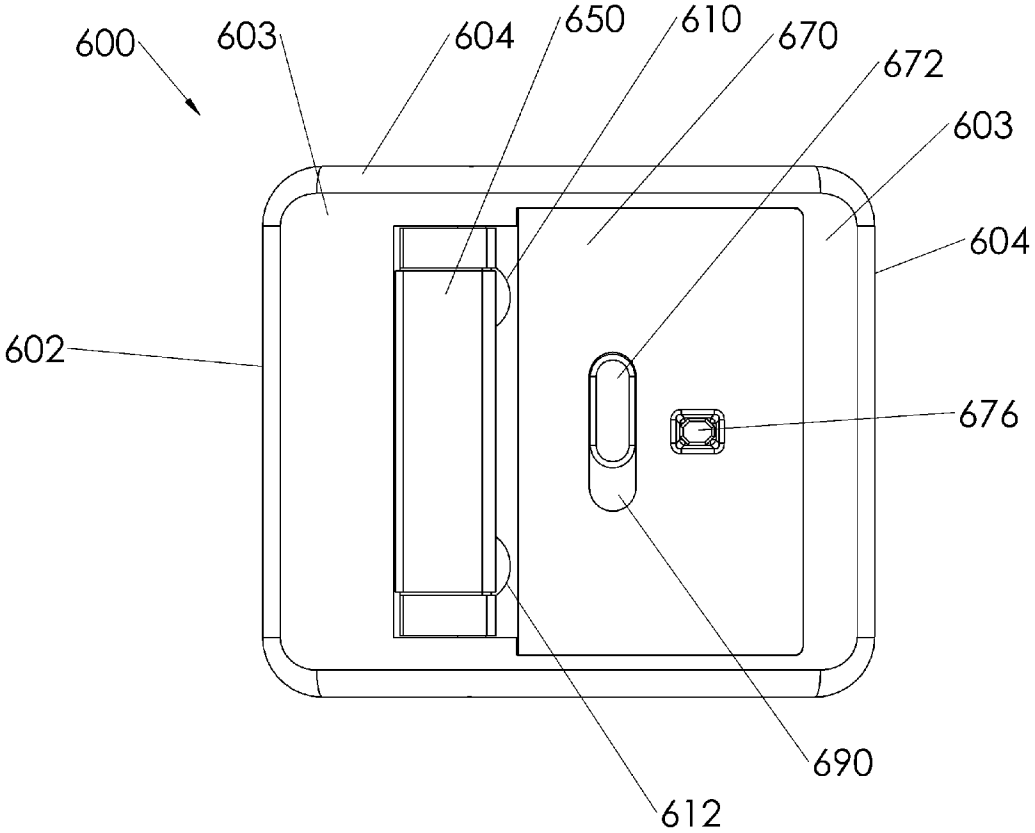
FIG. 28 is a top view of the belt buckle shown in FIG. 27.
Figure 29:
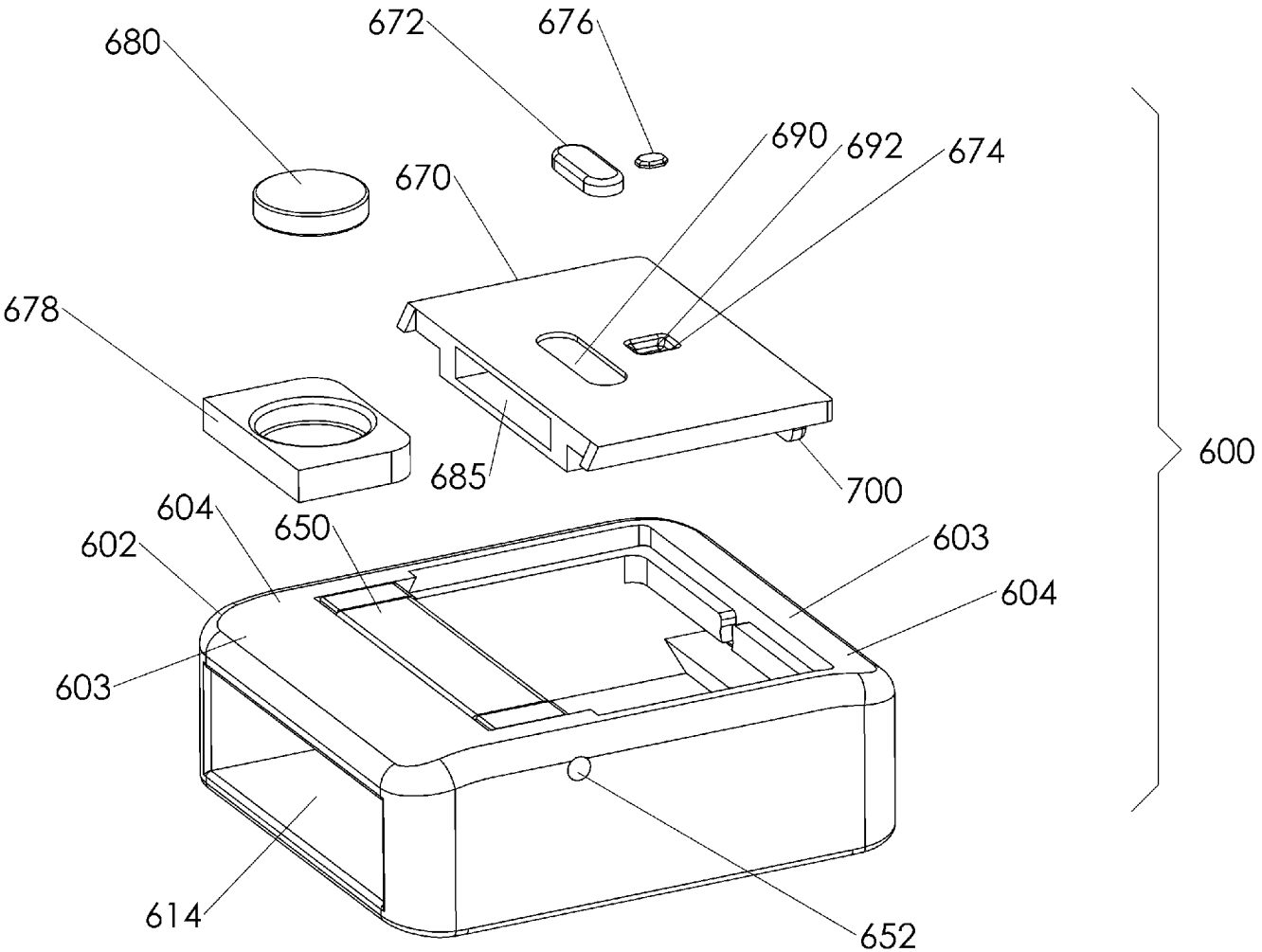
FIG. 29 is an exploded view of the belt buckle shown in FIG. 27.

Referring to FIGS. 27, 28 and 29, there is shown belt buckle 600 in accordance with a further embodiment of the present invention. Belt buckle 600 comprises buckle body 602. Buckle body 602 has the same structure, shape and configuration as buckle body 402 which was described in the foregoing description and shown in FIG. 18A. Buckle body 602 comprises top side 603. Top side 603 includes peripheral portion 604. Belt buckle 600 includes friction pads 610 and 612 which are fixed to the interior, bottom surface 614 of buckle body 602. Friction pads 610 and 612 provide the same function as friction pads 500 and 502 described in the foregoing description and shown in FIG. 18A. Belt buckle 600 further comprises pivoting member 650 that has the same structure, shape and configuration as pivoting member 450 which was described in the foregoing description. Pivoting member 650 comprises pin member 652 that is attached to buckle body 602 and allows pivoting member 650 to pivot in the same manner and directions as pivoting member 450. Pivoting member 650 provides the same function as pivoting member 450. Belt buckle 600 further comprises cover 670. Cover 670 is configured to be removably attached to buckle body 602 in generally the same way that cover 460 is removably attached to buckle body 402. Cover 670 is frictionally fitted within peripheral portion 604 of buckle body 602. Cover 670 comprises a light assembly which comprises switch button 672, light emitting device 674, transparent light cover 676, battery holder 678 and battery 680. Battery 680 fits into battery holder 678. Cover 670 is configured to include compartment 685 on the bottom side thereof. Compartment 685 is sized to receive batter holder 678 with battery 680. Also located within compartment 685, but not visible, are electrical wires, the light switch and the electrical wires or leads of light emitting device 674. The light emitting device 674, battery 680, light switch, and electrical wires form an electrical circuit. Any suitable electrical switch known in the art can be used to realize the aforementioned light switch. Switch button 672 is movably positioned within opening 690 in cover 670 and is attached to the light switch located in compartment 685. Transparent light cover 676 is sized to frictionally fit within opening 692 in cover 670. A wearer can activate the light emitting device 674 by pushing switch button 672 in the proper position. Light emitting device 674 can be configured as a light-emitting diode (LED) or any other suitable light-emitting device. In other embodiments, the light-emitting device 674 can be configured to be a flashing light, or mini-strobe light or a non-flashing light. Light-emitting device 674 can be configured to provide different color lights. On the bottom side of cover 670, there is structure 700 which is similar to structure 50 shown in FIG. 11. Structure 700 is configured to be attached to buckle body 602 in the same way that structure 50 is attached to buckle body 12 (see FIGS. 1, 2, 4 and 11).

Belt 200 may be fabricated from any one of variety of materials known in the art, e.g. leather, synthetic leather, plastic, resin, fabric, etc. Portions of belt buckles 10, 400 and 600 may be made from any suitable materials such as plastic, resin, polymers, composite materials, metal, etc. In a preferred embodiment, tension band 100 (see FIG. 4) is fabricated from a material having the requisite elasticity. Belt buckles 10, 400 and 600 may be configured to have different sizes for use with belts having different widths or thicknesses. Belt buckles 10, 400 and 600 may be configured with different colors and ornamental designs. Belt buckles 10, 400 and 600 may be worn with either side facing the wearer's torso. For example, belt buckle 400 may be worn with side 406 facing outward and side 412 facing the wearer's torso, or with side 406 facing the wearer's torso and side 412 facing outward.

The foregoing description of the preferred embodiments of the invention has been presented for purposes of illustration and description only. It is neither intended to be exhaustive nor to limit the invention to the precise form disclosed; and obviously many modifications and variations are possible in light of the above teaching. Such modifications and variations that may be apparent to a person skilled in the art are intended to be included within the scope of this invention as defined by the accompanying claims.

What is claimed is:

1. A belt buckle comprising:

a buckle body comprising an interior region and a first side having an opening that exposes the interior region, the first side comprising a peripheral portion that extends about opening, the buckle body further comprising a second side that is opposite to the first side, a first buckle end and an opposite second buckle end, each buckle end having an opening that provides access to the interior region, the openings and the interior region being sized to allow a portion of a belt to pass therethrough, the buckle body further comprising a pair of sidewalls that are contiguous with the first buckle end and second buckle end, the buckle body further comprising an interior bottom surface, and at least one upstanding tab attached to the interior bottom surface and sized to be frictionally fitted into a corresponding opening in a belt end;

a pivoting member pivotally attached to the sidewalls of the buckle body and extending across the interior region, the pivoting member being configured to pivot to a first position wherein the pivoting member physically contacts a portion of a belt (200) when the portion of the belt (200) is within the interior region, and to a second position that allows belt (200) to be moved through the interior region and through the openings of the buckle ends in either one direction (350) or an opposite direction (352);

a cover that is removably attached to the peripheral portion of the first side and positioned within the opening, the cover being sized to cover a portion of the interior region and having a first end that is in proximity to and spaced apart from the pivoting member by a gap, the cover having a second end that is adjacent to the peripheral portion, a top side and a bottom side, the bottom side having a structure extending therefrom, the cover further comprising a light assembly comprising a light-emitting device and a source of electrical power electrically connected to the light-emitting device to activate the light-emitting device; and wherein when the pivoting member is positioned in the first position and a belt end (202) is positioned within the interior region and attached to the buckle body and a movable belt section (204) is positioned within the interior region and over belt end (202), tensile forces on belt (200) cause the pivoting member to firmly and frictionally contact the movable belt section (204) so as to prevent movement of the movable belt section (204) in direction (352), and wherein when the pivoting member is positioned in the second position, there is a clearance between the pivoting member and the movable belt section (204) so that movable belt section (204) can move in either direction (350) or (352), and wherein when a wearer desires to prevent further movement of movable belt section (204) in direction (352), the wearer pivots the pivoting member to the first position so that tensile stress on the belt (200) causes the pivoting member to firmly and frictionally contact the movable belt section (204).

2. The belt buckle according to claim 1 wherein the pivoting member comprises:

a body section having a longitudinally extending bore; and a pin member disposed within the longitudinally extending bore, the pin member having a pair of ends, wherein each end is attached to a corresponding sidewall.

3. The belt buckle according to claim 2 wherein the pivoting member further comprises a sleeve that is fabricated from a material having a relatively high coefficient of friction, the body section being disposed within the sleeve, wherein the sleeve firmly and frictionally contacts belt section (204) when tensile forces are on the belt (200).

4. The belt buckle according to claim 1 wherein the light assembly further comprises a switch that can be configured in a first position that prevents electrical circuit so that electrical power from being applied to the light-emitting device and to a second position that causes electrical power to be applied to the light-emitting device so that the light-emitting device is activated.

5. The belt buckle according to claim 4 wherein the cover has a slot therein and wherein the light assembly further comprises a slide button accessible through the slot and engaged with the switch to allow a user to configure the switch in the first position or the second position.

6. The belt buckle according to claim 1 wherein the light assembly further comprises a transparent light cover positioned over the light-emitting device.

7. The belt buckle according to claim 1 wherein the electrical power source is a battery.

8. The belt buckle according to claim 7 wherein the light assembly further comprises a battery holder sized to hold the battery.

9. The belt buckle according to claim 1 wherein the light-emitting device is a light-emitting diode.

10. The belt buckle according to claim 1 wherein the light-emitting device is a flashing light.

11. The belt buckle according to claim 1 wherein the light-emitting device is a constant light or non-flashing light.

12. The belt buckle according to claim 1 wherein the light-emitting device is a strobe light.

13. The belt buckle according to claim 1 wherein the light-emitting device provides colored light.

* * * * *